US006755730B2

(12) United States Patent
Geib et al.

(10) Patent No.: US 6,755,730 B2
(45) Date of Patent: Jun. 29, 2004

(54) DISC-TYPE COIN PROCESSING DEVICE HAVING IMPROVED COIN DISCRIMINATION SYSTEM

(75) Inventors: Joseph J. Geib, Hot Springs Village, AK (US); John R. Blake, St. Charles, IL (US); David J. Wendell, Darien, IL (US); Scott D. Casanova, Roselle, IL (US); David J. Mecklenburg, Glendale Heights, IL (US); Eric J. Strauts, Park Ridge, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 74 days.

(21) Appl. No.: 10/095,164

(22) Filed: Mar. 11, 2002

(65) Prior Publication Data

US 2003/0168309 A1 Sep. 11, 2003

(51) Int. Cl.[7] ..... G07D 3/00; G07D 5/00

(52) U.S. Cl. ..... 453/3; 194/302

(58) Field of Search ..... 453/3, 9, 12, 13, 453/29, 49, 33; 194/302, 342

(56) References Cited

U.S. PATENT DOCUMENTS

| | | | | |
|---|---|---|---|---|
| 3,376,970 A | * | 4/1968 | Roseberg | 53/501 |
| 3,771,583 A | | 11/1973 | Bottemiller | 160/327 |
| 3,837,139 A | * | 9/1974 | Roseberg | 53/501 |

(List continued on next page.)

FOREIGN PATENT DOCUMENTS

| | | | |
|---|---|---|---|
| EP | 1 104 920 A1 | 6/2001 | G07D/5/08 |
| GB | 2 121 582 A | 12/1983 | G07D/3/14 |
| WO | 97/25692 | 7/1997 | G07D/3/06 |
| WO | 99/33030 | 7/1999 | G07D/3/00 |

OTHER PUBLICATIONS

"The Electrical Engineering Handbook", 2nd Ed. Published by CRC Press and IEEE in 1997, Edited by Richard C. Dorf, pp. 23–31.

Complaint, Cummins–Allison Corp. v. Glory Ltd., Glory Shoji Co. Ltd., and Glory (U.S.A.) Inc., Civil Action No. 02C–7008, United States District Court, Northern District of Illinois, Eastern Division.

Billcon Corporation, Brochure for CCS–60/CCS–80 Series Coin Counter–Sorter, 2 pages (Oct. 1999).

Billcon Corporation, Photos for CCS–60/80, 1 page (Japanese language) (Oct. 12, 2000).

De La Rue Cash Systems, Inc., Brochure for ACD Automatic Coin Dispenser, 2 pages (no date).

De La Rue Cash Systems, Brochure for MACH 12 Coin Sorter/Counter, 2 pages (1999).

De La Rue Cash Systems, Brochure for MACH 12HD Coin Sorter/Counter, 2 pages (no date).

(List continued on next page.)

*Primary Examiner*—Donald P. Walsh
*Assistant Examiner*—Mark Beauchaine
(74) *Attorney, Agent, or Firm*—Jenkens & Gilchrist

(57) ABSTRACT

A coin processing system for processing a plurality of coins of mixed denominations comprises a rotatable disc for imparting motion to the plurality of coins, a sensor for differentiating between valid and invalid coins, a stationary sorting head, a diverter and a controller. The stationary sorting head has a lower surface generally parallel to and spaced slightly away from the rotatable disc. The lower surface forms a queuing channel and a plurality of exit channels for sorting and discharging coins of particular denominations. The queuing channel has a first segment for receiving coins and a second segment for moving the coins past the sensor and is configured to move coins at a faster rate along the second segment for increasing the spacing between adjacent coins. The diverter is disposed along the second segment beyond the sensor and is moveable between a first position for permitting coins to proceed to the plurality of exit channels and a second position for diverting coins to a reject region. The controller moves the diverter from the first position to the second position when the sensor detects an invalid coin.

197 Claims, 12 Drawing Sheets

U.S. PATENT DOCUMENTS

| | | | | | |
|---|---|---|---|---|---|
| 4,184,366 | A | | 1/1980 | Butler | 73/163 |
| 4,228,812 | A | | 10/1980 | Marti | 133/3 F |
| 4,436,103 | A | | 3/1984 | Dick | 133/3 |
| 4,474,197 | A | | 10/1984 | Kinoshita et al. | 133/4 A |
| 4,488,116 | A | | 12/1984 | Plesko | 324/236 |
| 4,556,140 | A | | 12/1985 | Okada | 194/4 |
| 4,564,036 | A | * | 1/1986 | Ristvedt | 453/10 |
| 4,607,649 | A | * | 8/1986 | Taipale et al. | 453/6 |
| 4,681,128 | A | | 7/1987 | Ristvedt et al. | 453/6 |
| 4,731,043 | A | * | 3/1988 | Ristvedt et al. | 453/6 |
| 4,753,624 | A | * | 6/1988 | Adams et al. | 453/10 |
| 4,753,625 | A | | 6/1988 | Okada | 453/32 |
| 4,863,414 | A | | 9/1989 | Ristvedt et al. | 453/6 |
| 4,936,435 | A | | 6/1990 | Griner | 194/317 |
| 5,022,889 | A | | 6/1991 | Ristvedt et al. | 453/6 |
| 5,026,320 | A | | 6/1991 | Rasmussen | 453/6 |
| 5,141,443 | A | | 8/1992 | Rasmussen et al. | 453/10 |
| 5,277,651 | A | | 1/1994 | Rasmussen et al. | 453/10 |
| 5,299,977 | A | | 4/1994 | Mazur et al. | 453/10 |
| 5,345,206 | A | | 9/1994 | Morcos | 335/222 |
| 5,379,875 | A | | 1/1995 | Shames et al. | 194/317 |
| 5,382,191 | A | | 1/1995 | Rasmussen | 453/11 |
| 5,429,550 | A | | 7/1995 | Mazur et al. | 453/10 |
| 5,453,047 | A | | 9/1995 | Mazur et al. | 453/10 |
| 5,480,348 | A | | 1/1996 | Mazur et al. | 453/10 |
| 5,507,379 | A | | 4/1996 | Mazur et al. | 194/318 |
| 5,542,880 | A | | 8/1996 | Geib et al. | 453/10 |
| 5,630,494 | A | | 5/1997 | Strauts | 194/317 |
| 5,743,373 | A | | 4/1998 | Strauts | 194/318 |
| 5,988,348 | A | * | 11/1999 | Martin et al. | 194/317 |
| 5,992,602 | A | | 11/1999 | Zwieg et al. | 194/317 |
| 6,047,808 | A | | 4/2000 | Neubarth et al. | 194/317 |
| 6,056,104 | A | | 5/2000 | Neubarth et al. | 194/317 |
| 6,080,056 | A | | 6/2000 | Karlsson | 453/3 |
| 6,171,182 | B1 | | 1/2001 | Geib et al. | 453/10 |
| 6,196,371 | B1 | | 3/2001 | Martin et al. | 194/317 |
| 6,264,545 | B1 | | 7/2001 | Magee et al. | 453/3 |
| 6,412,620 | B1 | | 7/2002 | Imura | 194/317 |
| 6,431,342 | B1 | | 8/2002 | Schwartz | 194/346 |
| 6,471,030 | B1 | | 10/2002 | Neubarth et al. | 194/317 |
| 6,503,138 | B2 | | 1/2003 | Spoehr et al. | 453/10 |
| 6,640,956 | B1 | | 11/2003 | Zwieg et al. | 194/328 |
| 2002/0074209 | A1 | | 6/2002 | Karlsson | 194/330 |

OTHER PUBLICATIONS

Glory, Brochure for GSA–500 Sortmaster, 2 pages (no date).
Magner, Brochure for COINSTREAM™ CPS 502 Self–Service Coin Processing System, 2 pages (no date).
Magner, Brochure for MAG II 100 Series Coin Sorter, 2 pages (no date).
Magner, Brochure for MAG II Model 915 Coin Counter/Packager, 2 pages (no date).
Magner, Brochure for Pelican 305 Coin Sorter, 2 pages (no date).
Magner, Brochure for 900 Series Coin Counters and Packagers, 2 pages (no date).
PCT International Search Report for International Application No. PCT/US03/06762, dated May 23, 2003 (3 pages).

* cited by examiner

DISC-TYPE COIN PROCESSING DEVICE HAVING IMPROVED COIN DISCRIMINATION SYSTEM

CROSS REFERENCE TO RELATED APPLICATION

Cross-Reference is made to copending U.S. patent application Ser. No. 10/095,256, entitled "Sensor And Method For Discriminating Coins Of Varied Composition, Thickness, And Diameter," filed on Mar. 11, 2002, which is incorporated herein by reference in its entirety.

FIELD OF THE INVENTION

The present invention relates generally to coin processing devices and, more particularly, to a coin processing device having a improved coin discrimination system for discriminating between valid and invalid coins and removing the invalid coins.

BACKGROUND OF THE INVENTION

Generally, disc-type coin sorters sort coins according to the diameter of each coin. Typically, in a given coin set such as the United States coin set, each coin denomination has a different diameter. Thus, sorting coins by diameter effectively sorts the coins according to denomination.

Disc-type coin sorters typically include a resilient pad (disposed on a rotating disc) that rotates beneath a stationary sorting head having a lower surface positioned parallel to the upper surface of the resilient pad and spaced slightly therefrom. The rotating, resilient pad presses coins upward against the sorting head as the pad rotates. The lower surface of sorting head includes a plurality shaped regions including exit channels for manipulating and controlling the movement of the coins. Each of the exit channels is dimensioned to accommodate coins of a different diameter for sorting the coins based on diameter size. As coins are discharged from the sorting head via the exit channels, the sorted coins follow respective coin paths to sorted coin receptacles where the sorted coins are stored.

It is desirable in the sorting of coins to discriminate between valid coins and invalid coins. Use of the term "valid coin" refers to coins of the type to be sorted. Use of the term "invalid coin" refers to items being circulated on the rotating disc that are not one of the coins to be sorted. For example, it is common that foreign or counterfeit coins (e.g., slugs) enter the coin sorting system. So that such items are not sorted and counted as valid coins, it is helpful to detect and discard these "invalid coins" from the coin processing system. In another application wherein it is desired to process (e.g., count and/or sort) only U.S. quarters, nickels and dimes, all other U.S. coins including dollar coins, half-dollar coins and pennies are considered "invalid." Additionally, coins from all other coins sets including Canadian coins and Euro coins, for example, would be considered "invalid" when processing U.S. coins. Finally, any truly counterfeit coins (i.e., a slug) are always considered "invalid" in any application. In another application it may be desirable to separate Canadian coins from U.S. coins for example. Therefore, in that application all authentic U.S. and Canadian coins are considered invalid, and all non-authentic U.S. and Canadian coins and all coins from other coin sets (e.g., Euro coins) are considered invalid.

Typically, prior-art disc-type coin sorters include a discrimination sensor disposed within each exit channel for discriminating between valid and invalid coins as coins enter the exit channels. In such systems, therefore, coins entered the exit channel and are then discriminated. An invalid coin having a diameter that enables it to pass into an exit channel moves past the discrimination sensor. The discrimination sensor detects the invalid coin and a braking mechanism is triggered to stop the rotating disc before the invalid coin is moved out of the exit channel. A diverter, disposed within the coin path external, or internal, to the sorting head, moves such that a coin entering the coin path is diverted to an invalid coin receptacle. The sorting head is then jogged (electronically pulsed) causing the disc to incrementally rotate until the invalid coin is discharged from the exit channel to the coin path where it is diverted to a invalid coin receptacle. The diverter is moved back to its home position such that coins now entering the coin path are directed to the coin receptacles for valid coins. The coin sorter is then restarted and the disc begins to rotate at the normal sorting rate of speed.

One drawback associated with this type of prior art discrimination technique is the downtime consumed by the aforementioned stopping, jogging and restarting of the rotatable disc to remove the invalid coin. This process often takes approximately five seconds per invalid coin. Initially, this may appear to be a relatively insignificant amount of time; however, this time can add up to a significant amount of time in the processing of bulk coins.

Furthermore, because the rotatable disc rapidity breaks and stops so that an invalid coin is not ejected from a coin exit channel before the diverter is moved to route invalid coins to a reject receptacle, the overall speed (i.e., the number of rotations of the rotatable disc per minute) is limited. Additionally, this type prior art discrimination technique results in more "wear and tear" on the breaking system and motor.

Accordingly, a need exists for a coin processing machine that can discriminate invalid coins at a high-rate of speed.

SUMMARY OF THE INVENTION

A coin processing system for processing a plurality of coins of mixed denominations comprises a rotatable disc for imparting motion to the plurality of coins, a sensor for differentiating between valid and invalid coins, a stationary sorting head, a diverter and a controller. The stationary sorting head has a lower surface generally parallel to and spaced slightly away from the rotatable disc. The lower surface forms a queuing channel and a plurality of exit channels for sorting and discharging coins of particular denominations. The queuing channel has a first segment for receiving coins and a second segment for moving the coins past the sensor and is configured to move coins at a faster rate along the second segment for increasing the spacing between adjacent coins. The diverter is disposed along the second segment beyond the sensor and is moveable between a first position for permitting coins to proceed to the plurality of exit channels and a second position for diverting coins to a reject region. The controller moves the diverter from the first position to the second position when the sensor detects an invalid coin.

The above summary of the present invention is not intended to represent each embodiment, or every aspect, of the present invention. Additional features and benefits of the present invention will become apparent from the detailed description, figures, and claims set forth below.

Figure 1:
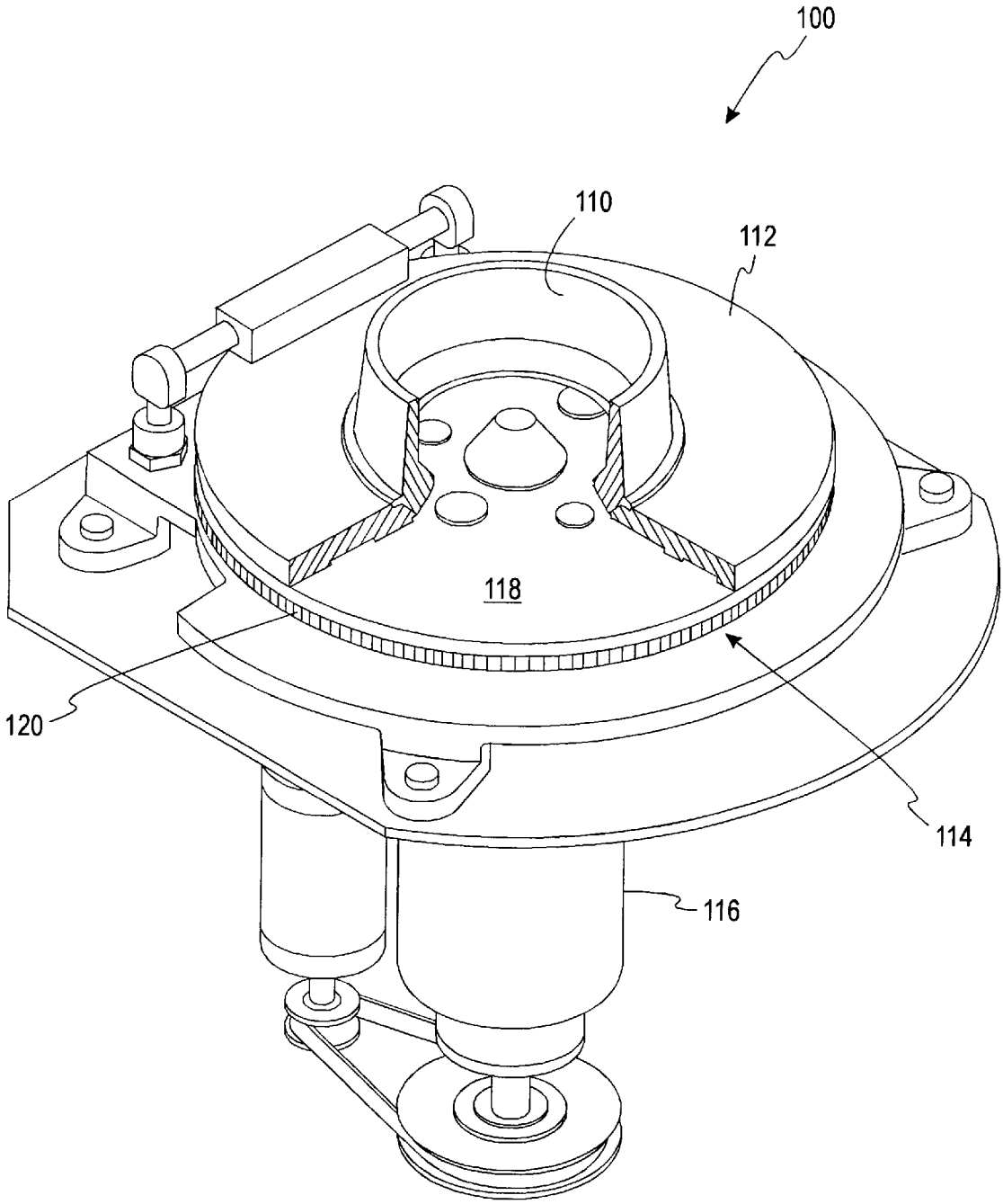
FIG. 1 is a perspective view of a coin processing system, according to one embodiment of the present invention, with portions thereof broken away to show the internal structure.

While the invention is susceptible to various modifications and alternative forms, specific embodiments will be shown by way of example in the drawings and will be desired in detail herein. It should be understood, however, that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE ILLUSTRATED EMBODIMENTS

Turning now to the drawings and referring first to FIG. 1, a disc-type coin processing system 100 according to one embodiment of the present invention is shown. The coin processing system 100 includes a hopper 110 for receiving coins of mixed denominations that feeds the coins through a central opening in an annular sorting head 112. As the coins pass through this opening, they are deposited on the top surface of a rotatable disc 114. This rotatable disc 114 is mounted for rotation on a shaft (not shown) and driven by an electric motor 116. The disc 114 typically comprises a resilient pad 118, preferably made of a resilient rubber or polymeric material, bonded to the top surface of a solid disc 120. While the solid disc 120 is often made of metal, it can also be made of a rigid polymeric material.

According to one embodiment, coins are initially deposited by a user in a coin tray (not shown) disposed above the coin processing system 100 shown in FIG. 1. The user lifts the coin tray which funnels the coins into the hopper 110. A coin tray suitable for use in connection with the coin processing system 100 is described in detail in U.S. Pat. No. 4,964,495 entitled "Pivoting Tray For Coin Sorter," which is incorporated herein by reference in its entirety.

As the disc 114 is rotated, the coins deposited on the resilient pad 118 tend to slide outwardly over the surface of the pad 118 due to centrifugal force. As the coins move outwardly, those coins which are lying flat on the pad 118 enter the gap between the surface of the pad 118 and the sorting head 112 because the underside of the inner periphery of the sorting head 112 is spaced above the pad 118 by a distance which is about the same as the thickness of the thickest coin. As is further described below, the coins are processed and sent to exit stations where they are discharged. The coin exit stations may sort the coins into their respective denominations and discharge the coins from exit channels in the sorting head 112 corresponding to their denominations.

Figure 2:
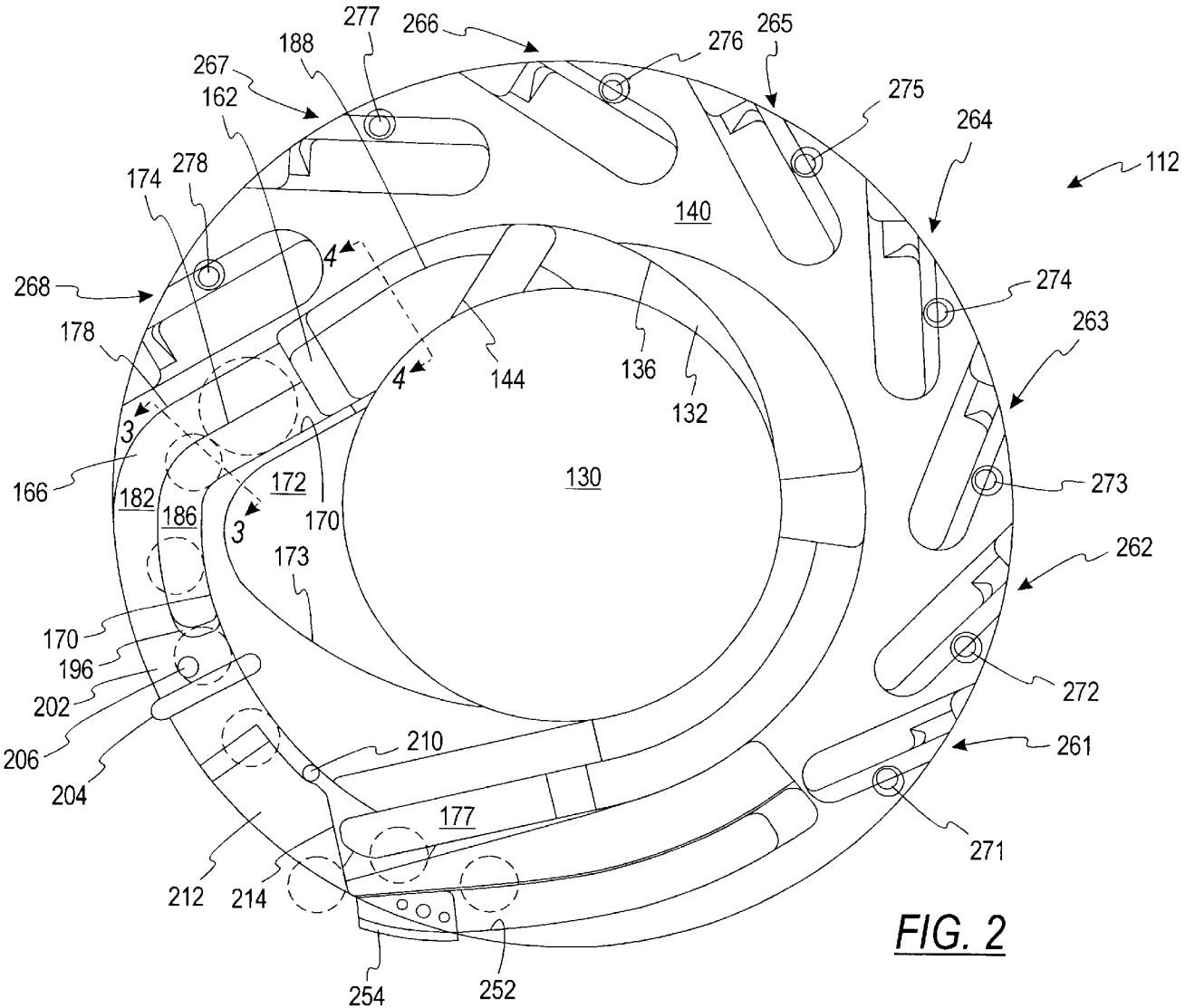
FIG. 2 is an enlarged bottom view of a sorting head for use with the system of FIG. 1.

Referring now to FIG. 2, the underside of the sorting head 112 is shown. The coin sets for any given country are sorted by the sorting head 112 due to variations in the diameter size. The coins circulate between the sorting head 112 and the pad 118 (FIG. 1) on the rotatable disc 114 (FIG. 1). The coins are deposited on the pad 118 via a central opening 130 and initially enter the entry channel 132 formed in the underside of the sorting head 112. It should be keep in mind that the circulation of the coins in FIG. 2 appears counterclockwise as FIG. 2 is a view of the underside of the sorting head 112.

An outer wall 136 of the entry channel 132 divides the entry channel 132 from the lowermost surface 140 of the sorting head 112. The lowermost surface 140 is preferably spaced from the pad 118 by a distance that is slightly less than the thickness of the thinnest coins. Consequently, the initial outward radial movement of all the coins is terminated when the coins engage the outer wall 136, although the coins continue to move more circumferentially along the wall 136 (in the counterclockwise directed as viewed in FIG. 2) by the rotational movement imparted to the coins by the pad 118 of the rotatable disc 114.

In some cases, coins may be stacked on top of each other—commonly referred to as "stacked" coins or "shingled" coins. Some of these coins, particularly thicker coins, will be under pad pressure and cannot move radially outward toward wall 136 under the centrifugal force. Stacked coins which are not against the wall 136 must be recirculated and stacked coins in contact against the wall 136 must be unstacked. To unstack the coins, the stacked coins encounter a stripping notch 144 whereby the upper coin of the stacked coins engages the stripping notch 144 and is channeled along the stripping notch 144 back to an area of the pad 118 disposed below the central opening 130 where the coins are then recirculated. The vertical dimension of the stripping notch 144 is slightly less the thickness of the thinnest coins so that only the upper coin is contacted and stripped. While the stripping notch 144 prohibits the further circumferential movement of the upper coin, the lower coin continues moving circumferentially across stripping notch 144 into the queuing channel 166.

Stacked coins that may have bypassed the stripping notch 144 by entering the entry channel 132 downstream of the stripping notch 144 are unstacked after the coins enter the queuing channel 166 and are turned into an inner queuing wall 170 of the queuing channel 166. The upper coin contacts the inner queuing wall 170 and is channeled along the inner queuing wall 170 while the lower coin is moved by the pad 118 across the inner queuing wall 170 into the region defined by surface 172 wherein the lower coin engages a wall 173 and is recirculated. Other coins that are not properly aligned along the inner queuing wall 170, but that are not recirculated by wall 173, are recirculated by recirculating channel 177.

As the pad 118 continues to rotate, those coins that were initially aligned along the wall 136 (and the lower coins of stacked coins moving beneath the stripping notch 144) move across the ramp 162 leading to the queuing channel 166 for aligning the innermost edge of each coin along the inner queuing wall 170. In addition to the inner queuing wall 170, the queuing channel 166 includes a first rail 174 and a second rail 178 that form the outer edges of stepped surfaces 182 and 186, respectively. The stepped surfaces 182, 186 are acutely angled with respect to the horizontal. The surfaces 182 and 186 are sized such that the width of surface 182 is less than that of the smallest (in terms of the diameter) coins and the width of surface 184 is less than that of the largest coin.

Figure 3:
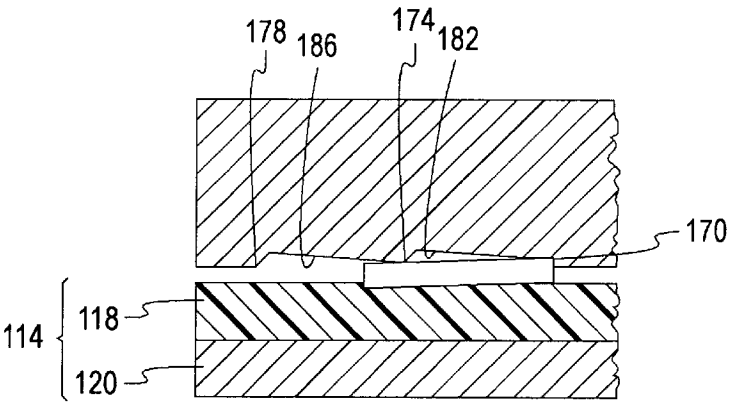
FIG. 3 is a cross-sectional view of the sorting head shown in FIG. 2 taken along line 3—3.

Referring for a moment to FIG. 3, a small diameter coin (e.g. a dime or a 1¢ Euro coin) is shown pressed into pad 118 by the first rail 174 of the sorting head 112. The rails 174, 178 are dimensioned to be spaced away from the top of the pad 118 by a distance less than the thickness of the thinnest coin so that the coins are gripped between the rail 174, 178 and the pad 118 as the coins move through the queuing channel 166. The coins are actually slightly tilted with respect to the sorting head 112 such that their outermost edges are digging into the pad 118. Consequently, due to this positive pressure on the outermost edges, the innermost edges of the coins tend to rise slightly away from the pad 118.

Referring back to FIG. 2, the coins are gripped between one of the two rails 174, 178 and the pad 118 as the coins are rotated through the queuing channel 166. The coins, which were initially aligned with the outer wall 136 of the entry channel 130 as the coins moved across the ramp 162 and into the queuing channel 166, are rotated into engagement with inner queuing wall 170. Because the queuing channel 166 applies a greater amount of pressure on the outside edges of the coins, the coin are less likely to bounce off the inner queuing wall 170 as the radial position of the coin is increased along the inner queuing wall 170.

Figure 4B:
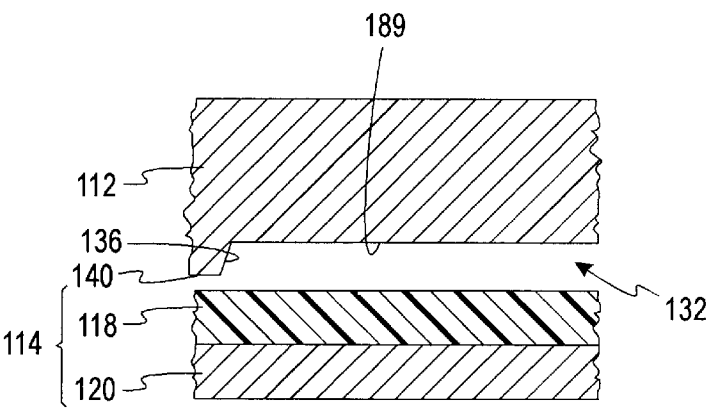
FIG. 4*b* is a cross-sectional view of an alternative embodiment of that which is shown in FIG. 4*a;*
Figure 4A:
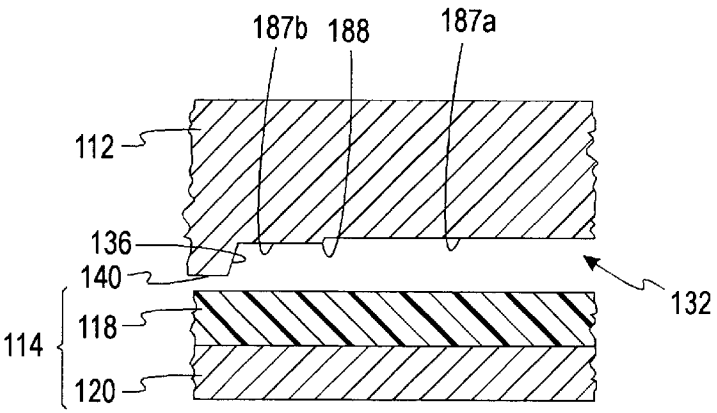
FIG. 4*a* is a cross-sectional view of the sorting head shown in FIG. 2 taken along 4—4.

Referring to FIG. 4*a*, the entry region 132 of the embodiment of the sorting head 112 shown in FIG. 2 includes two stepped surfaces 187*a*, 187*b* forming a rail 188 therebetween. According to an alternative embodiment of the sorting head 112, the entry channel 132 consists of one surface 189 as shown in FIG. 4*b*.

Figure 5:
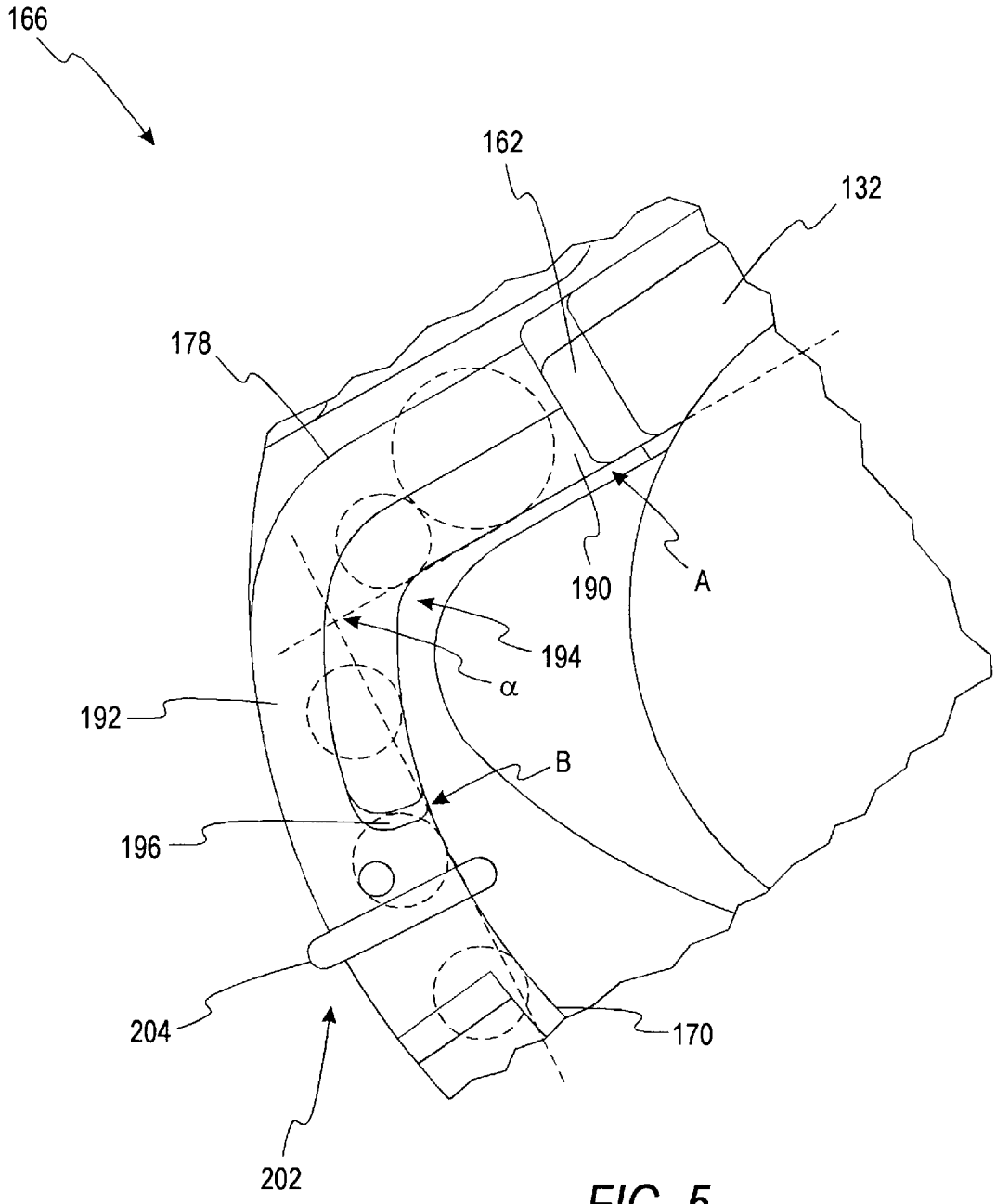
FIG. 5 is an oversize view of a queuing channel of the sorting head shown in FIG. 2.

Referring now to FIG. 5, there is shown an oversized view of the queuing channel 166 of FIG. 2. It can be seen that the queuing channel 166 is generally "L-shaped." The L-shaped queuing channel 166 is considered in two segments—a first upstream segment 190 and a second downstream segment 192. The upstream segment 190 receives the coins as the coins move across the ramp 162 and into the queuing channel 166. The coins enter the downstream segment 192 as the coins turn a corner 194 of the L-shaped queuing channel 166. As the pad 118 continues to rotate, the coins move along the second segment 192 and are still engaged on the inner queuing wall 170. The coins move across a ramp 196 as the coins enter a discrimination region 202 and a reject region having a reject channel 212 for off-sorting invalid coins, which are both located towards the downstream end of the second segment 192. The discrimination region includes a discrimination sensor 204 for discriminating between valid and invalid coins and/or identifying the denomination of coins.

The queuing channel 166 is designed such that a line tangent to the inner queuing wall 170 of the L-shaped queuing channel 166 at about the point where coins move past the ramp 196 into the discrimination region 202 (shown as point A in FIG. 5) forms an angle alpha ($\alpha$) with a line tangent to the inner queuing wall 170 at about the point where coins move over ramp 162 into the queuing channel 166 (shown as point B in FIG. 5). According to one embodiment of the present invention, the angle alpha ($\alpha$) is about 100°. According to alternative embodiments of the coin processing system 100, the angle alpha ($\alpha$) ranges between about 90° and about 110°.

As the pad 118 continues to rotates, the L-shape of the queuing channel 166 imparts spacing to the coins which are initially closely spaced, and perhaps abutting one another, as the coins move across the ramp 162 into the queuing channel 166. As the coins move along the first upstream segment 190 of the queuing channel 166, the coins are pushed against inner queuing wall 170 and travel along the inner queuing wall 170 in a direction that is transverse to (i.e., generally unparallel) the direction in which the pad 118 is rotating. This action aligns the coins against the inner queuing wall 170. However, as the coins round the corner 194 into the second downstream segment 192 of the queuing channel 166, the coins are turned in a direction wherein they are moving with the pad (i.e., in a direction more parallel to the direction of movement of the pad). A coin rounding the corner 194 is accelerated as the coin moves in a direction with the pad; thus, the coin is spaced from the next coin upstream. Put another way, the first segment 190 receives coins from the entry channel 132 and the second segment 192 is disposed in a position that is substantially more in direction of movement of said rotatable disc 114 for creating an increased spacing between adjacent coins. Accordingly, the coins moving through the second segment 192 are spaced apart. According to one embodiment of the present invention, the coins are spaced apart by a time of approximately five milliseconds when the sorting head 112 has an eleven inch diameter and the pad 118 rotates at a speed of approximately three hundred revolutions per minute (300 r.p.m.). According to an alternative embodiment, the coins are spaced apart by a distance of less than about two inches when the sorting head 112 has an eleven inch diameter and the pad 118 rotates at a speed of about 350 r.p.m.

Referring back to FIG. 2, as the coins move into the discrimination region 202 of the second segment 194, the coins move across ramp 196 and transition to a flat surface of the discrimination region 202 as the pad 118 continues to rotate. Put another way, the two stepped surfaces 182, 186 of the queuing channel 166 transition into the flat surface of the discrimination region 202 towards the downstream end of the second segment 194. The pad 118 holds each coin flat against the flat surface of the discrimination region 202 as the coins are moved past the discriminator sensor 204 in the downstream second segment 194.

The sorting head 112 includes a cutout for the discrimination sensor 204. The discrimination sensor 204 is disposed just below the flat surface of the discrimination region 202. Likewise, a coin trigger sensor 206 is disposed just upstream of the discrimination sensor 204 for detecting the presence of a coin. Coins first move over the coin trigger sensor 206

(e.g., a photo detector or a metal proximity detector) which sends a signal to a controller indicating that a coin is approaching the coin discrimination sensor 204.

According to one embodiment, the coin discrimination sensor 204 is adapted to discriminate between valid and invalid coins. As discussed in the Background Section, use of the term "valid coin" refers to coins of the type to be sorted. Use of the term "invalid coin" refers to items being circulated on the rotating disc that are not one of the coins to be sorted. Any truly counterfeit coins (i.e., a slug) are always considered "invalid." According to another alternative embodiment of the present invention, the coin discriminator sensor 204 is adapted to identify the denomination of the coins and discriminate between valid and invalid coins.

Coin discrimination sensors suitable for use with the disc-type coin sorter shown in FIGS. 1 and 2 are describe in detail in U.S. Pat. Nos. 5,630,494 and 5,743,373, both of which are entitled "Coin Discrimination Sensor And Coin Handling System" and are incorporated herein by reference in their entries. Another coin discrimination sensor suitable for use with the present invention is described in detail in copending U.S. patent application Ser. No. 10/095,256, entitled "Sensor And Method For Discriminating Coins Of Varied Composition, Thickness, And Diameter," filed on Mar. 11, 2002, which is incorporated herein by reference.

As discussed above according to one alternative embodiment of the present invention, the discrimination sensor 204 discriminates between valid and invalid coins. Downstream of the discrimination sensor 204 is a diverting pin 210 disposed adjacent inner queuing wall 170 that is movable to a diverting position (out of the page as viewed in FIG. 2) and a home position (into the page as viewed in FIG. 2). In the diverting position, the diverting pin 210 directs coins off of inner queuing wall 170 and into a reject channel 212. The reject channel 212 includes a reject wall 214 that rejected coins abut against as they are off-sorted to the periphery of the sorting head 112. Off-sorted coins are directed to a reject area (not shown). Coin that are not rejected (i.e., valid coins) eventually engage an outer wall 252 of a gauging channel 250 where coins are aligned on a common radius for entry into the coin exit station area as is described in greater detail below.

According to one embodiment of the present invention, the diverting pin 210 is coupled to a voice coil (not shown) for moving the diverting pin between the diverting position and the home position. Using a voice coil in this application is a nontraditional use for voice coils, which are commonplace in acoustical applications as well as in servo-type applications. Typically, a discrete amount of voltage is applied to the voice coil for moving the windings of the voice coil a discrete amount within the voice coil's stroke length—the greater the voltage, the greater the movement. However, the Applicants have discovered that the when the voice coil is "flooded" with a positive voltage, for example, the voice coil rapidly moves the diverting pin 210 coupled thereto to the diverting position (i.e., the end of the voice coil's stroke length) within a very short time period that is less than the time it takes for the coins to move from the discrimination sensor 204 to the diverter pin 210 when increased spacing is encountered due to the queuing channel. The voice coil is then flooded with a negative voltage for rapidly moving the diverting pin 210 windings back to its home position.

A voice coil suitable for use with the present invention is described in U.S. Pat. No. 5,345,206, entitled "Moving Coil Actuator Utilizing Flux-Focused Interleaved Magnetic Circuit," which is incorporated herein by references in its entirety. As an example, a voice coil manufactured by BEI, Technologies, Inc. of San Francisco, Calif., model number LA15-16-024A, can move an eighth-inch (⅛ in) stroke (e.g., from the home position to the diverting position) in approximately 1.3 milliseconds, which is a speed of about 0.1 inch per millisecond, and can provide approximately twenty pounds of force in either direction. Other voice coils are suitable for use with the coin sorting system of FIG. 2.

Other types of actuation devices can be used in alternative embodiments of the present invention. For example, a linear solenoid or a rotary solenoid may be used to move a pin such as diverting pin 210 between a diverting position and a home position.

As the pad 118 continues to rotate, those coins not diverted into the reject channel 212 continue along inner queuing wall 170 to the gauging region 250. The inner queuing wall 170 terminates just downstream of the reject channel 212; thus, the coins no longer abut the inner queuing wall 170 at this point and the queuing channel 166 terminates. The radial position of the coins is maintained, because the coins remain under pad pressure, until the coins contact an outer wall 252 of the gauging region 252. According to one embodiment of the present invention, the sorting head 112 includes a gauging block 254 which extends the outer wall 252 beyond the outer periphery of the sorting head 112. The gauging block 254 is useful when processing larger diameter coins such as casino tokens, $1 coins, 50¢ pieces, etc. that extend beyond he outer periphery of the sorting head 112. According to the embodiment of the sorting head 112 shown in FIG. 2, the gauging channel 250 includes two stepped surfaces to form rails similar to that described above in connection with the queuing channel 166. In alternative embodiments, the gauging channel 250 does not include two stepped surfaces.

The gauging wall 252 aligns the coins along a common radius as the coins approach a series of coin exit channels 261–268 which discharge coins of different denominations. The first exit channel 261 is dedicated to the smallest coin to be sorted (e.g., the dime in the U.S. coin set). Beyond the first exit channel 261, the sorting head 112 shown in FIG. 2 forms seven more exit channels 261–268 which discharge coins of different denominations at different circumferential locations around the periphery of the sorting head 112. Thus, the exit channels 261–268 are spaced circumferentially around the outer periphery of the sorting head 112 with the innermost edges of successive channels located progressively closer to the center of the sorting head 112 so that coins are discharged in the order of increasing diameter. The number of exit channels can vary according to alternative embodiments of the present invention.

The innermost edges of the exit channels 261–268 are positioned so that the inner edge of a coin of only one particular denomination can enter each channel 261–268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 118. To maintain a constant radial position of the coins, the pad 118 continues to exert pressure on the coins as they move between successive exit channels 261–268.

According to one embodiment of the sorting head 112, each of the exit channels 261–268 includes a coin counting sensor 271–278 for counting the coins as coins pass though and are discharged from the coin exit channels 261–268. In an embodiment of the coin processing system utilizing a discrimination sensor capable of determining the denomination of each of the coins, it is not necessary to use the coin counting sensors 271–278 because the discrimination sensor 204 provides a signal that allows the controller to determine the denomination of each of the coins. Through the use of the system controller (FIG. 6), a count is maintained of the number of coins discharged by each exit channel 261–268.

Figure 6:
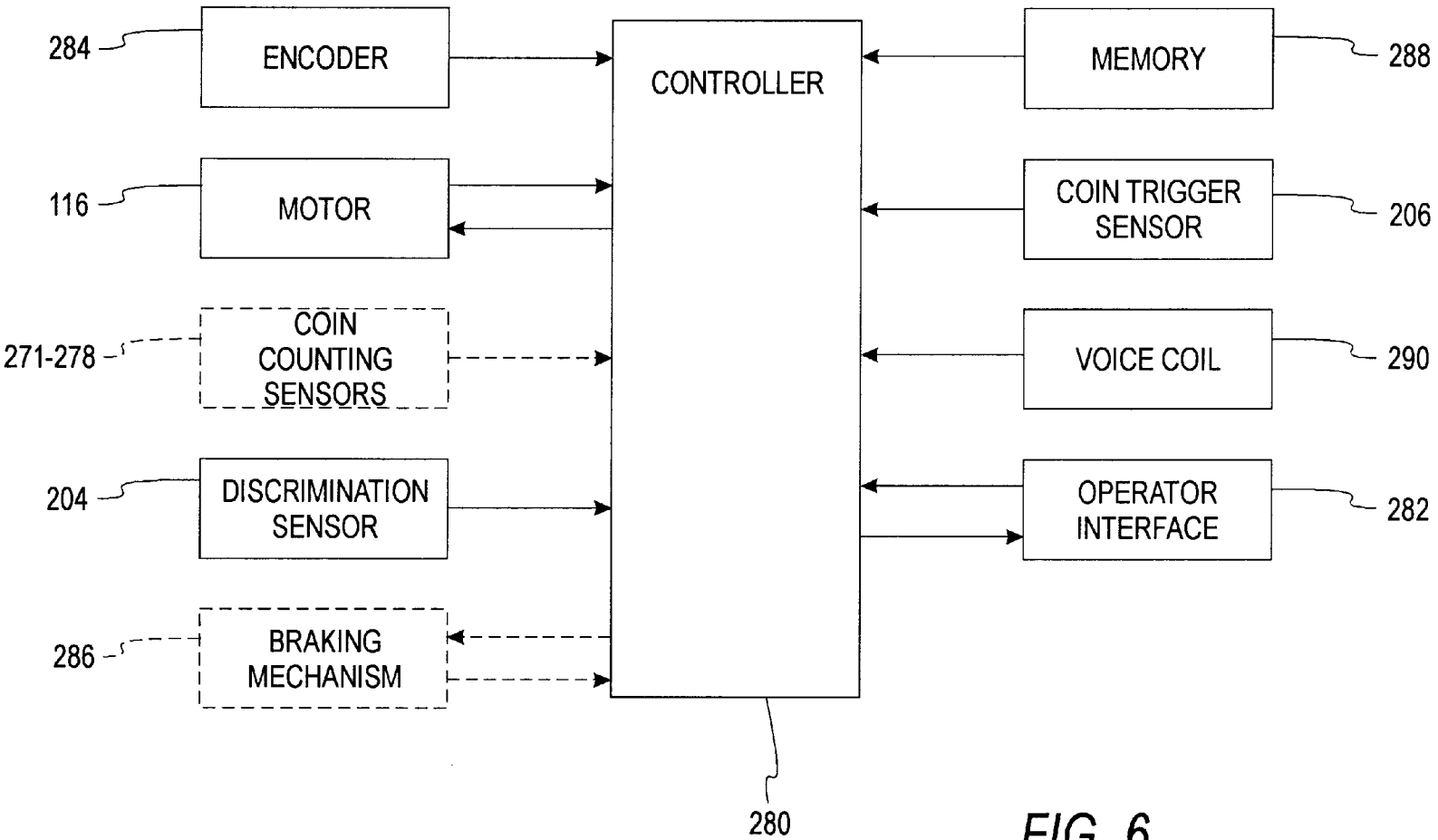
FIG. 6 is a functional block diagram of the control system for the a coin processing system shown in FIG. 1.

FIG. 6 illustrates a system controller 280 and its relationship to the other components in the coin processing system 100. The operator communicates with the coin processing system 100 via an operator interface 282 for receiving information from an operator and displaying information to the operator about the functions and operation of the coin processing system 100. The controller 280 monitors the angular position of the disc 114 via an encoder 284 which sends an encoder count to the controller 280 upon each incremental movement of the disc 114. Based on input from the encoder 284, the controller 280 determines the angular velocity at which the disc 114 is rotating as well as the change in angular velocity, that is the acceleration and deceleration, of the disc 114. The encoder 284 allows the controller 280 to track the position of coins on the sorting head 112 after being sensed. According to one embodiment of the coin processing system 100, the encoder has a resolution of 2000 pulses per revolution of the disc 114.

Furthermore, the encoder 284 can be of a type commonly known as a dual channel encoder that utilizes two encoder sensors (not shown). The signals that are produced by the two encoder sensors and detected by the controller 280 are generally out of phase. The direction of movement of the disc 114 can be monitored by utilizing the dual channel encoder.

The controller 280 also controls the power supplied to the motor 116 which drives the rotatable disc 114. When the motor 116 is a DC motor, the controller 280 can reverse the current to the motor 116 to cause the rotatable disc 114 to decelerate. Thus, the controller 270 can control the speed of the rotatable disc 114 without the need for a braking mechanism.

If a braking mechanism 280 is used, the controller 280 also controls the braking mechanism 286. Because the amount of power applied is proportional to the braking force, the controller 280 has the ability to alter the deceleration of the disc 114 by varying the power applied to the braking mechanism 286.

According to one embodiment of the coin processing 100, the controller 280 also monitors the coin counting sensors 271–278 which are disposed in each of the coin exit channels 261–268 of the sorting head 112 (or just outside the periphery of the sorting head 112). As coins move past one of these counting sensors 271–278, the controller 280 receives a signal from the counting sensor 271–278 for the particular denomination of the passing coin and adds one to the counter for that particular denomination within the controller 280. The controller 280 maintains a counter for each denomination of coin that is to be sorted. In this way, each denomination of coin being sorted by the coin processing system 100 has a count continuously tallied and updated by the controller 280. The controller 280 is able to cause the rotatable disc 114 to quickly terminate rotation after a "n" number (i.e., a predetermined number) of coins have been discharged from an exit channel, but before the "n+1" coin has been discharged. For example, it may be necessary to stop the discharging of coins after a predetermined number of coins have been delivered to a coin receptacle, such as a coin bag, so that each bag contains a known amount of coins, or to prevent a coin receptacle from becoming overfilled. Alternatively, the controller 280 can cause the system to switch between bags in embodiments having more than one coin bag corresponding to each exit channel.

The controller 280 also monitors the output of coin discrimination sensor 204 and compares information received from the discrimination sensor 204 to master information stored in a memory 288 of the coin processing system 100 including information obtained from known genuine coins. If the received information does not favorably compare to master information stored in the memory 288, the controller 280 sends a signal to the voice coil 290 causing the diverting pin 210 to move to the diverting position.

According to one embodiment of the coin processing system 100, after a coin moves past the trigger sensor 206, the coin discrimination sensor 204 begins sampling the coin. The discrimination sensor 204 begins sampling the coins within about 30 microseconds ("$\mu$s") of a coin clearing the trigger sensor 206. The sampling ends after the coin clears a portion or all of the discrimination sensor 204. A coin's signature, which consists of the samples of the coin obtained by the discrimination sensor 204, is sent to the controller 280 after the coin clears the trigger sensor 206 or, alternatively, after the coin clears the discrimination sensor 204. As an example, when the coin processing system 100 operates as a speed of 350 r.p.m. and the sorting head 112 has a diameter of eleven inches, it takes approximately 3900 $\mu$s is for a 1¢ Euro coin (having a diameter of about 0.640 inch) to clear the trigger sensor 206. A larger coin would take more time.

The controller 280 then compares the coin's signature to a library of"master" signatures obtained from known genuine coins stored in the memory 288. The time required for the controller 280 to determine whether a coin is invalid is dependent on the number of master signatures stored in the memory 288 of the coin processing system 100. According to one embodiment of the present invention, there are thirty-two master signatures stored in the memory 288, while other embodiments may include any practical number of master signatures. Generally, regardless of the number of stored signatures, the controller 280 determines whether to reject a coin in less than 250 $\mu$s.

After determining that a coin is invalid, the controller 280 sends a signal to activate the voice coil 290 for moving the diverting pin 210 to the diverting position. As shown in FIG. 2, the diverting pin 210 is located about 1.8 inches downstream from the trigger sensor 206 on the eleven inch sorting head. Assuming an operating speed of 350 r.p.m., for example, the controller 280 activates the voice coil 290 within about 7300 $\mu$s from the time that the coin crosses the trigger sensor 206. As discussed above, the voice coil 290 is capable of moving the diverting pin 210 approximately an ⅛ inch in about 1300 $\mu$s.

Therefore, assuming an eleven inch sorting disk, an operational speed of 350 r.p.m. and a trigger sensor 206, discrimination sensor 204 and a diverting pin 210 arrangement as shown in FIG. 2, about 11000 $\mu$s (11 milliseconds) elapses from the time a coin crosses the trigger sensor 206 until the diverting pin 210 is lowered to the diverting position. Thus, the diverting pin 210 is located less than about two inches downstream of the trigger sensor 206. Accordingly, the spacing between coins crossing the trigger sensor 206 is less than about two inches.

Once the diverting pin 210 is moved to the diverting position, the diverting pin 210 remains in the diverting position until a valid coin is encountered by the discrimination sensor 204 according to one embodiment of the present invention. This reduces wear and tear on the voice coil 190. For example, the diverting pin 210 will only be moved to the diverting position one time when three invalid coins in a row are detected, for example, in applications involving a heavy mix of valid and invalid coins. If the fourth coin is determined to be a valid coin, the diverting pin 210 is moved to its home position. Further, according to some embodiments of the coin processing system 100, the diverting pin 210 is moved to the home position if the trigger sensor 206 sensor does not detect a coin within about two seconds of the last coin that was detected by the trigger sensor 206, which can occur when a batch of coins being processed in nearing the end of the batch. This reduces wear and tear on the pad 118, which is rotating beneath the diverting pin 210 because the diverting pin 210 and the rotating pad 118 are in contact when the diverting pin 210 is in the diverting position.

Because of the spacing imparted to the coins via the L-shaped queuing channel 166, it is not necessary to slow or stop the machine to off-sort the invalid coins. Rather, the combination of the increased spacing and fast-activating voice coil 290 contribute to the ability of the coin sorter system illustrated in FIGS. 1 and 2 to be able to discriminate coins on the fly.

The superior performance of coin processing systems according to one embodiment of the present invention is illustrated by the following example. Prior art coin sorters, such as those discussed in the Background Section where is was necessary to stop and then jog the disc to remove an invalid coin, that utilized an eleven inch sorting disc were capable of sorting a retail mix of coins at a rate of about 3000 coins per minute when operating at a speed for about 250 r.p.m. (A common retail mix of coins is about 30% dimes, 28% pennies, 16% nickels, 15% quarters, 7% half-dollar coins, and 4% dollar coins.) The ability to further increase the operating speed of these prior art devices is limited by the need to be able to quickly stop the rotation of the disc before the invalid coin is discharged as is discussed in the Background Section. According to one embodiment of the coin processing system 100 of FIGS. 1 and 2, the system 100 is cable of sorting a retail mix of coins at a rate of about 3300 coins per minute when the sorting head 112 has a diameter of eleven inches and the disc is rotated at about 300 r.p.m. According to another embodiment of the present invention, the coin processing system 100 is capable of sorting a "Euro financial mix" of coins at rate of about 3400 coins per minute, wherein the sorting head 112 has a diameter of eleven inches and the disc is rotated at about 350 r.p.m (A common Euro financial mix of coins made up of about 41.1% 2 Euro coins, about 16.7% 1 Euro coins, about 14.3% 50¢ Euro coins, about 13.0% 20¢ Euro coins, about 11.0% 10¢ Euro coins, about 12.1% 5¢ coins and about 8.5% 1¢ Euro coins.)

In one embodiment of the coin processing system 100, the coin discrimination sensor 210 determines the denomination of each of the coins as well as discriminates between valid and invalid coins, and does not include coin counting sensors 271–278. In this embodiment, as coins move past one the discrimination sensor 204, the controller 280 receives a signal from discrimination sensor 204. When the received information favorably compares to the master information, a one is added to a counter for that particular determined denomination within the controller 280. The controller 280 has a counter for each denomination of coin that is to be sorted. As each coin is moved passed the discrimination sensor 204, the controller 280 is now aware of the location of the coin and is able to track the angular movement of that coin as the controller receives encoder counts from the encoder 284. Therefore, referring back to the previous coin bag example, the controller 280 is able to determined at the precise moment at which to stop the rotating disc 114 such that the "nth" coin is discharged from a particular output channel 261–286, but the "n+1" coin is not. For example, in an application requiring one thousand dimes per coin bag, the controller counts number of dimes sensed by the discrimination sensor 204 and the precise number of encoder counts at which it should halt the rotation of the disc 114—when the 1000th dime is discharged from the coin exit channel, but not the 1001st dime.

Figure 7A:
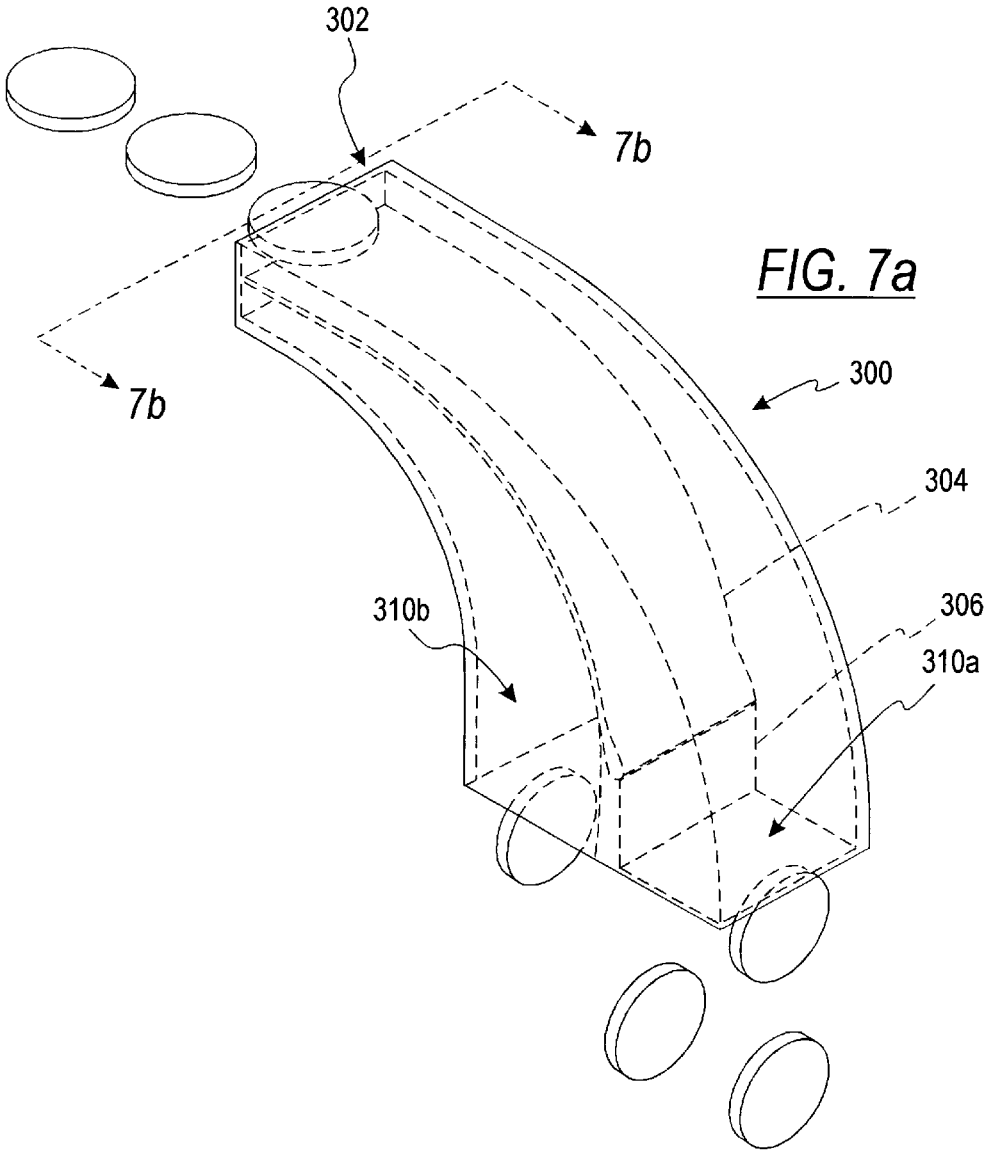
FIG. 7*a* is a perspective view of an external diverter according to one alternative embodiment of the present invention.
Figure 7B:
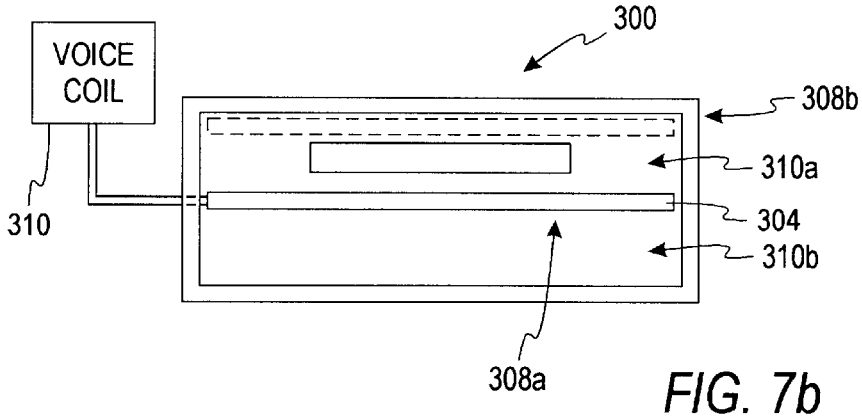
FIG. 7*b* is a front end view of the external diverter shown in FIG. 7*a* taken along line 7*b*–7*b;*

Referring now to FIGS. 7*a* and 7*b*, an external diverter 300 for use with an alternative embodiment of coin processing system 100 is shown. A plurality of external diverters 300 are arranged circumferentially around the sorting head 112 such that an inlet 302 of each external diverter 300 is disposed adjacent to each exit channel 261–268 for receiving coins discharged therefrom. The external diverters are used for separating valid and invalid coins according to one alternative embodiment of the coin processing system 100 in place of the voice coil 290 and pin 210. In another alternative embodiment, the diverter 300 works in connection with the voice coil 290 and pin 210 and fuinctions to separate valid coins into two batches, rather than to separate invalid from valid coins.

The external diverter 300 includes an internal partition 304 that pivots about a base 306 between a first position 308*a* and a second position 308*b* wherein coins are directed down a first coin path 310*a* and a second coin path 310*b*, respectively. The internal partition 304 is coupled to a voice coil 310 for rapidly moving the internal partition 304 between the first and second positions 308*a,b*. In an alternative embodiment, the external diverter 300 is constructed such that the internal partition 304 moves from side-to-side (not up and down) to route coins between the two coin paths 310*a,b*.

According to one alternative embodiment of the coin processing system 100, the external diverters 300 are used in place of the diverting pin 210 (FIG. 2) for discriminating between valid and invalid coins. When an invalid coin is sensed by discrimination sensor 204 (FIG. 2), the controller 280 (FIG. 6) activates the voice coil 310 of the external diverters so that the invalid coin is directed down a second coin path 310*b*. The controller 280, with input from the encoder 284, is able to track the angular position of the invalid coin around the sorting head 112 as the pad 118 rotates. For each exit channel 261–268 and each corresponding external diverter 300, the controller 280 activates the voice coil 310 after a coin preceding the identified invalid coin has moved passed the exit channel 261–268, but before the identified invalid coin has reached the exit channel 261–268. For example, if the invalid coin has a diameter appropriate for the first exit channel 261, the invalid coin will be discharged from the first exit channel 261 into the second coin path 310*b* of the external diverter 300. The controller 280 sends a signal to the voice coil 310 to return internal partition 304 of the external diverter to the first position 308*a* before the coin immediately following the invalid coin reaches the first exit channel. The controller 280 repeats this sequence for each external diverter disposed around the sorting head. According to another alternative embodiment of the coin processing system 100, the controller is able to determine the diameter of each of the invalid coins using one or more sensors in the discrimination region 202 including the discrimination sensor 204, therefore, the controller 204 only activates the external diverter 300 of the exit channel 261–268 that is appropriate for the determined diameter of the invalid coin.

According to one alternative embodiment of the coin processing system 100, the external diverters 300 are used in connection with the sorting head of FIG. 2 which includes the diverting pin 210 (FIG. 2). The diverting pin 210 is used to off-sort invalid coins as described in connection with FIG. 2. The external diverters are used to separate the valid coins into two different batches. For example, in some applications the coin processing system 100 uses dual bag holders for each denomination and a predetermined number of coins discharged to each coin bag. The controller 280 maintains of a count of the coins discharged from each output receptacle and activates the external diverter 300 for routing coins to a second bag before the next coin is discharged from the corresponding exit channel 261–286. Again, because the controller 280 is tracking the angular movement of the disc 114 via the encoder 284, the controller 280 knows the precise moment that an identified valid coin is going to reach and be discharged from an exit channel.

Again, the generally L-shaped queuing channel 166 imparts a spacing to the coins allowing the coin processing system 100 to utilize the external diverters 300, which are rapidly actuated by the voice coils, on the fly. Accordingly, it is not necessary to slow or stop the rotating disc 144 when off-sorting invalid coins or routing coins down an alternate coin path.

Figure 8:
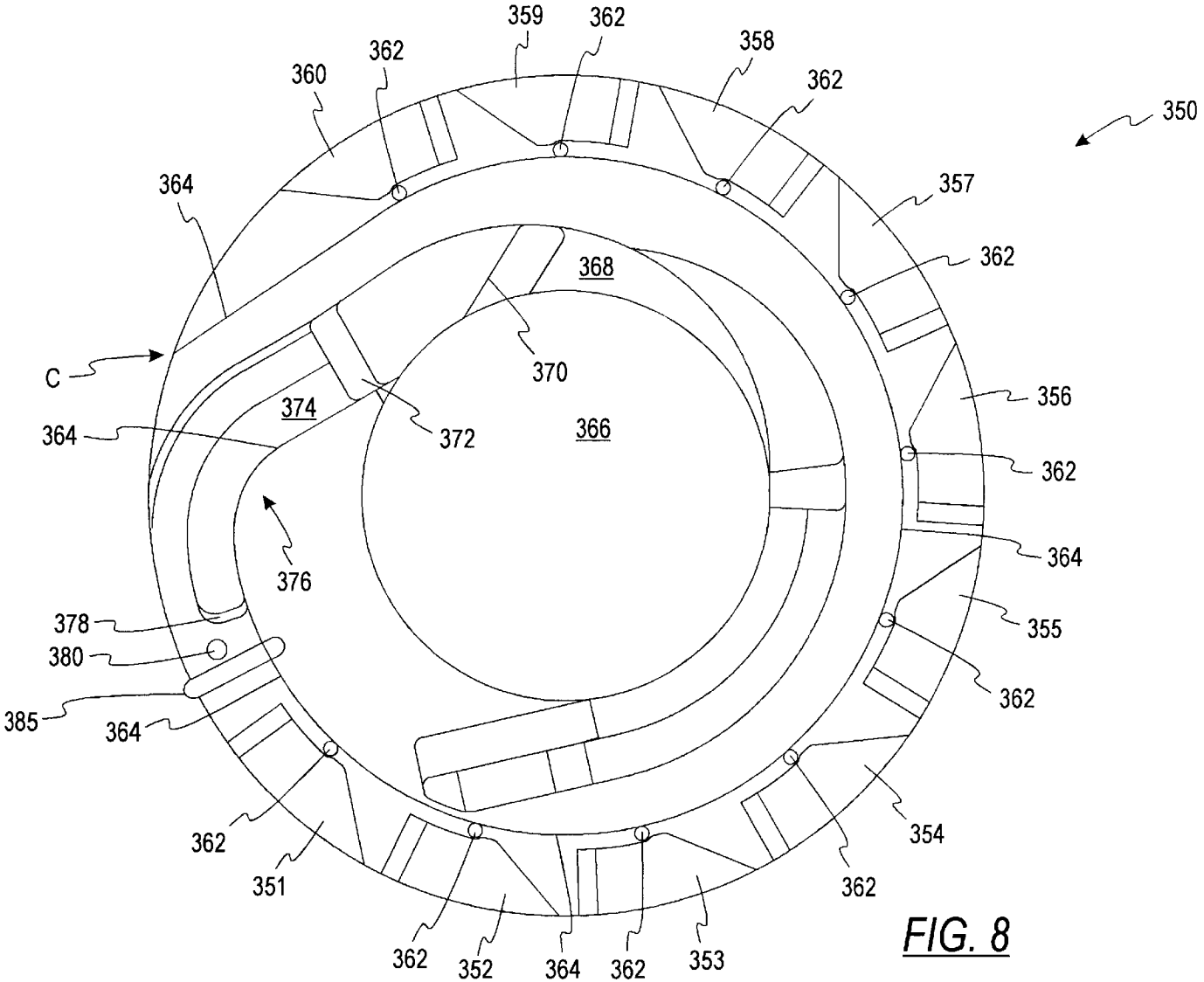
FIG. 8 is an enlarged bottom view of a programmable sorting head that can be used with the coin processing system of FIG. 1 instead of the sorting head shown in FIG. 2.

Referring now to FIG. 8, a programmable sorting head 350 is shown for use in an alternative embodiment of the coin processing system 100 of FIG. 1. Very generally, the exit channels 351–360 of the programmable sorting head 350 are substantially the same size so that coins of any denomination can be discharged out of any exit channel 351–360. Thus, the programmable sorting head 350 does not sort coins on the basis of diameter size; rather, coins are discriminated on the basis of information obtained from a discrimination sensor and are selectively distributed from the sorting head 350. Each of the exit channels 351–360 function similar to that of the reject channel 212 of FIG. 2. A diverting pin 362 is disposed adjacent each exit channel 351–360 and moves downward (out of the page in FIG. 8) to a diverting position for ejecting coins off of an inner queuing wall 364 into the corresponding exit channel 351–360.

The programmable sorting head 350 operates in a manner similar to the sorting head 112 described in connection with FIG. 2. Coins that are deposited on the rotating pad 118 via a central opening 366 in the programmable sorting head 350 initially enter an entry channel 368. As the pad 118 continues to rotate, coins are moved past a stripping notch for stripping stacked coins and then across a ramp, for increasing the pad pressure, into a queuing channel 374 having an inner queuing wall 364. In the embodiment of the programmable sorting head 350 depicted in FIG. 8, the queuing channel 374 includes three stepped surfaces and three rails (as opposed to two stepped surfaces and two rails for the sorting head 112 in FIG. 2). Alternatively, the queuing channel 374 consists of one surface.

The queuing channel 374 of the programmable sorting head 350 is L-shaped for imparting a spacing to the coins as the coins are moved past the corner 376 of the L-shaped queuing channel 374. The L-shaped queuing channel 374 of FIG. 8 imparts spacing to adjacent coins in the same manner as does the L-shaped queuing channel 166 described in connection with FIG. 2. Coins turning the corner 376 of the queuing channel 374 are accelerated and spaced-apart and engage the inner queuing channel wall 364. As the pad 118 continues to rotate, the coins aligned along wall 364 are move across a ramp 378 which transitions the coins to a flat surface for moving the coins past a coin trigger sensor 380 and a coin discrimination sensor 382.

The coin discrimination sensor 382 is adapted to discriminate between valid and invalid coins and to determine the denomination of each of the coins passing under the sensor 382. The function of the trigger sensor 380 and the discrimination sensor 382 is similar to that described in connection with FIG. 2. By processing input from the sensors 380, 382 and the encoder 284, the controller 280 tracks the angular position of each coin and is able to calculate the precise time to active a voice coil coupled to a pin 362 disposed adjacent to an exit channel 362. For example, if the coin discrimination sensor 382 determines that a coin is a dime and the coin sorting system is operating pursuant to a mode wherein dimes are to be off-sorted at the first exit channel 351, the pin 362 is lowered to the diverting position after the coin preceding the dime is moved past the first exit channel 351, but before the dime reaches the first exit channel. As the pad continues to rotates, the dime contacts the pin 362 and is knocked off the inner wall 365 into the first exit channel 351. The controller 280 raises the pin 362 before the next coin reaches the first exit channel 351. Put another way, the time to retract the pin 362 is less tan the time for the next coin to pass the pin 362 due to the increased spacing imparted to the coins by the L-shaped queuing channel 374.

In various alternative embodiments of the coin processing system 100 utilizing the programmable sorting head 350 ("the programmable processing system"), the programmable processing system operates pursuant to many predefined modes of operation and user-defined modes of operation. For example, the first exit channel 351 can operate as a reject chute for off-sorting invalid coins. In another embodiment, none of the exit channels 351–360 serve as reject chutes; rather, invalid coins are moved along wall 364 around the sorting head 350 and follow wall 364 off the sorting head at a point "C" where the coins are discharged to another off-sort area. In another application such as in the processing of coins obtained from vending machines, the first three exit channel 351–353 are used to sort nickels, dimes and quarters, respectively, until a predetermined number of coins of a denomination are delivered to the respective exit channel 351–353. Then the controller causes nickels, dimes and quarters to be off-sorted at the fourth, fifth and sixth exit channels 354–356, respectively, and so on. Accordingly, after a predetermined number of nickels have been discharged by the first exit channel 351, nickels are then off-sorted at the fourth exit channel 354, and then the by the seventh exit channel 357. No more than the predetermined number of coins are discharged from the exit channels 351–359 and the subsequent exit channel assigned to nickels, for example, is not utilized until the previous exit channel assigned to nickels has discharged a predetermined number of coins.

In another embodiment of the present invention, the programmable coin processing system operates pursuant to a mode of operation wherein the first ten coin denominations detected by the coin discrimination sensor 382 are the coin denominations assigned to the ten exit channels 351–360, respectively, and all other coins are off-sorted by following wall 364 off the sorting head 350 at point "C." As is readily apparent, the programmable sorting system can be utilized in pursuant to a myriad of modes of operation in alternative embodiments of the system.

In another embodiment of the present invention, the programmable coin processing system is utilized to separate coins from a plurality of coin sets—British pound coins, French Franc coins, German Deutschmark coins, U.S. coins, Italian Lira coins, Canadian coins and Euro coins, for example. The programmable coin processing system causes coins of each coin set to be distributed to one of the ten exit channels 351–360, while off-sorting other "invalid" coins. The programmable coins sorter can be linked to an external network which provides currency exchange rates so that the system can calculate the real-time value of all the coins processed from the different coin sets from different countries.

Figure 9:
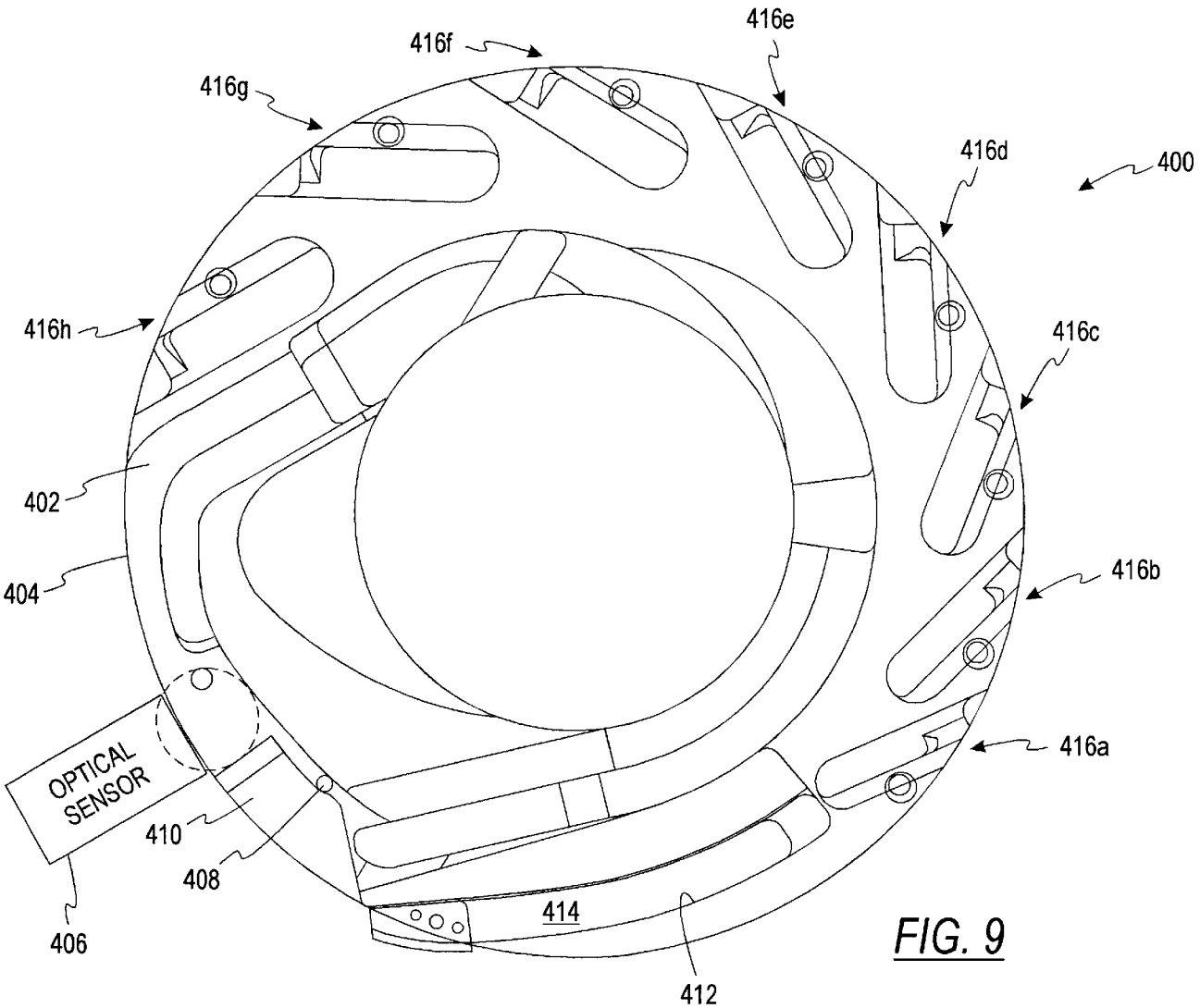
FIG. 9 is an enlarged bottom view of a sorting head and an external optical sensor that can be used with the coin processing system of FIG. 1 instead of the sorting head shown in FIG. 2.

In FIG. 9, an alternative embodiment of a sorting head 400 is shown for use with the coin processing system 100 of the present invention. While it will be recognized that the sorting head 400 is similar to the sorting head 112 shown in FIG. 2, the alternative embodiment to be discussed in connection with FIG. 9 is also applicable to a programmable coin sorting system such as that described in connection with FIG. 8.

The sorting head 400 is similar to that of FIG. 2 in that it is designed to impart spacing to adjacent coins; however, the queuing channel 402 is designed to move coins so that the outside edge of each of the coins extends beyond an outer periphery 404 of the sorting head 400 as the coins move past an optical sensor 406 for discriminating the coins. According to one embodiment, the optical sensor 406 is adapted to discriminate between valid and invalid coins. In another alternative embodiment, the optical sensor 406 is adapted to discriminate between valid and invalid coins and to identify the denomination of coins. The optical sensor 406 can comprise a photodetector, a charge-coupled device (CCD) detector, a metal oxide semiconductor (MOS) array, a line array, a camera, a scanning laser or other type of optical sensor according to various alternative embodiments.

The radial position of the queuing channel 402 is moved outward adistance such that the diameter of the smallest coin to be processed (e.g., the dime in the U.S. coin set) is moved beyond the outer periphery 404 of the sorting head 400 to obtain optical information from the coin. According to one embodiment, the coins must extend beyond the outer periphery 404 of the sorting head 400 at least about 0.010 inch (approximately 0.25 mm) for obtaining the optical information from the coin. A controller of the coin processing system 100 then processes the optical information obtained from each coin by the optical sensor 404. As the pad continues to rotate, the coin is brought back within the outer periphery 404 of the sorting head 400 as the coin moves past a diverting pin 408 and reject channel 410 similar to that described in connection with FIG. 2. Invalid coins are rejected via the reject channel 410 while valid coins are moved into engagement with an outer wall 412 of a gauging channel 414 for aligning the coins along a common radius as the coins approach the exit channels 416*a–h*.

Figure 10:
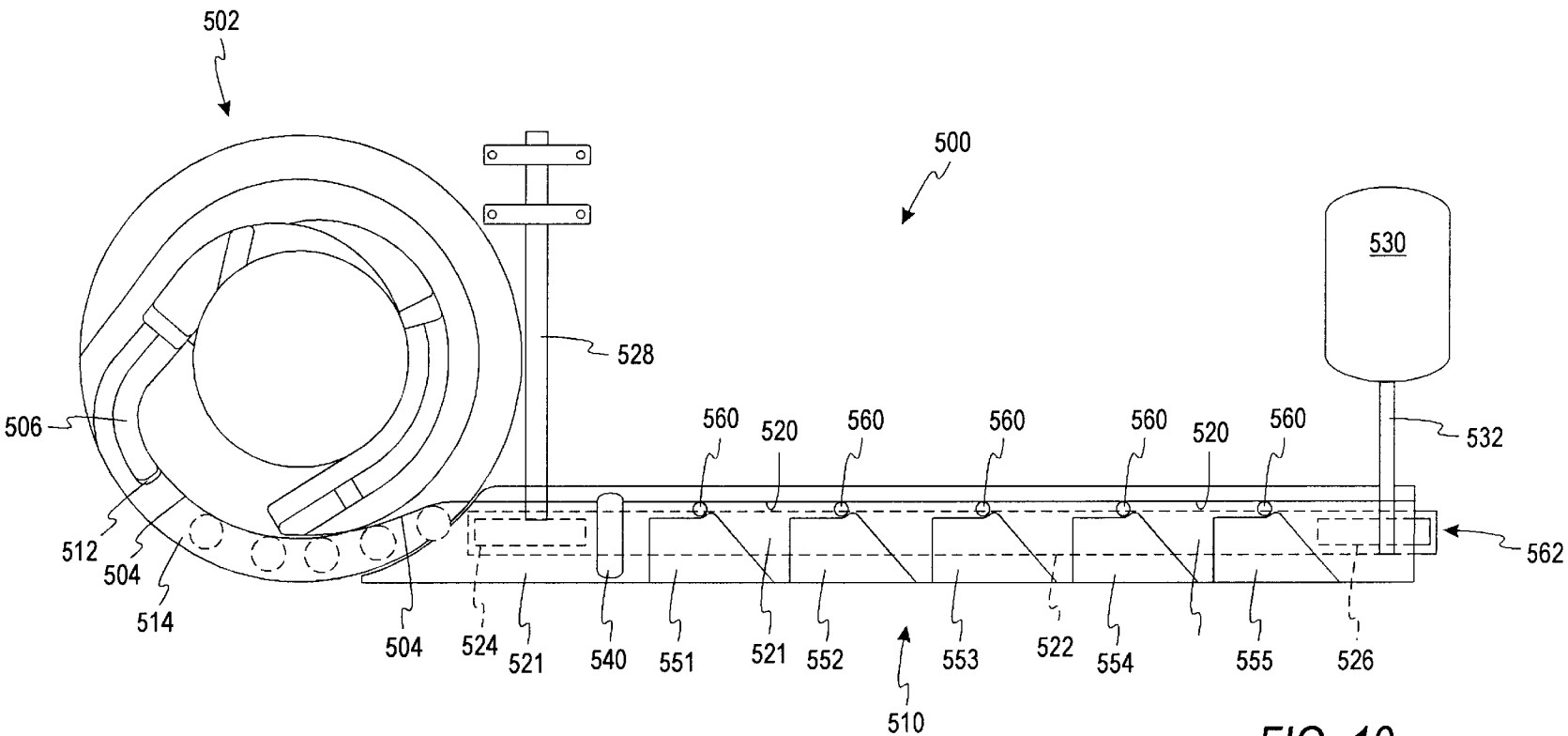
FIG. 10 is a top view of a programmable power rail coin processing system according to one alternative embodiment of the present invention.

Turning now to FIG. 10, a programmable power rail coin processing system 500 ("rail system 500") is shown according to an alternative embodiment of the present invention. The rail system 500 includes a guide plate 502 similar to the sorting head 350 shown and described in connection with FIG. 8. The guide plate 502 functions in substantially the same manner as the sorting head 350 in FIG. 8 by aligning coins, that are moved by a rotating disc, along an inner queuing channel wall 504 of a queuing channel 506, however, the guide plate 502 does not sort the coins. Rather, the coins are sorted along a rail 510 as is described in greater detail below.

It should be noted that the while underside of the guide plate 502 is shown in FIG. 10, tthe surface of the guide plate 502 shown in FIG. 10 faces downward while the rail 510 would face upward as shown in actual operation of the rail sorter 500. As with the sorting head in FIGS. 2 and 8, the queuing channel 506 of the guide plate 502 is generally L-shaped for imparting a spacing between adjacent coins. As the rotatable disc (similar to disc 114 of FIG. 1) continues to rotate, the coins are moved over a ramp 512 on to a flat surface 514 and along a wall 504. The guide plate 502 does not include any exit channels. Further, the guide plate 502 does not include a coin discrimination sensor as it can be disposed on the rail 510. Rather, the coins continue along the inner queuing wall 504 and are moved onto the rail 510 and into engagement with a wall 520 of the rail 510 while the underside of each coin contacts a flat surface 521 of the rail 510.

Figure 11:
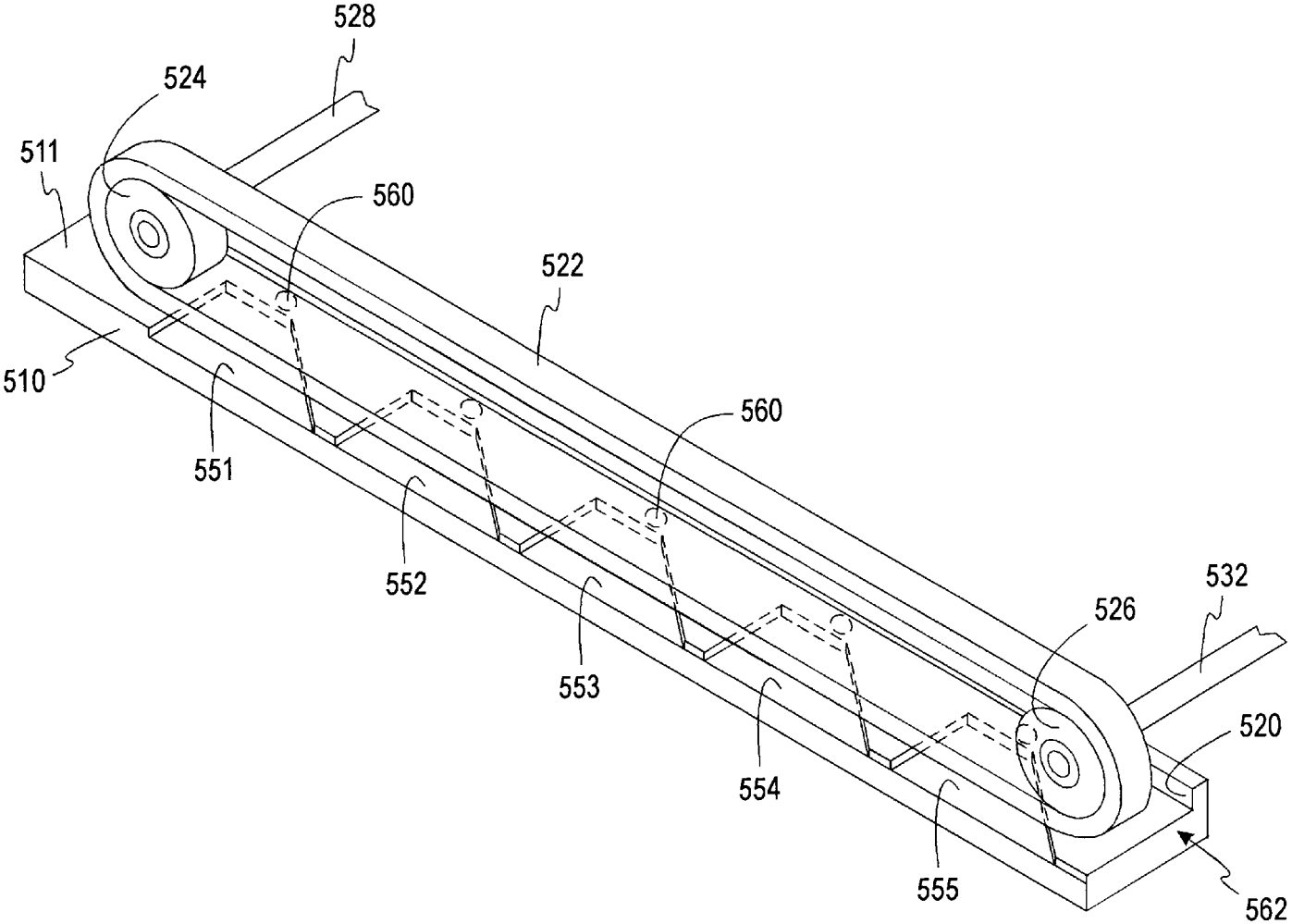
FIG. 11 is a perspective view of a rail and an endless belt for use with the programmable power rail coin processing system of FIG. 10.

Referring also to FIG. 11, an endless belt 522 that is looped around two pulleys 524, 526 is disposed along the longitudinal axis of the rail 510 and is disposed above the rail 510 a distance less than the thickness of the thinnest coin. (Note that the endless belt 522 is depicted with a dashed-line in FIG. 10.) The first pulley 524 rotates around a shaft 528 and the second pulley is driven by a motor 530 via another shaft 532. The belt 522, which is made out of a resilient material such as rubber, grips the coins as the upper surfaces of the coins come into contact with the belt 522 as the coins move from the guide plate 502 along the queuing wall 504 to the rail 510 and into engagement with the wall 520. The belt 522, which is in pressed engagement with the coins, moves the coins along the rail 510 while an underside of each coin slides along the flat surface 521 of the rail 510. The transition between the guide plate 502 and the rail 510 should appear substantially seamless to the coins so as not to decrease the spacing between the coins. The endless belt 522 moves at a speed sufficient to maintain the spacing between adjacent coins as the coins move onto the rail 510 and come under control of the belt 522. According to an alternative embodiment of the rail sorter 500, the belt 522 moves at a speed sufficient to increase the spacing between adjacent coins and no L-shaped queuing channel would be needed to increase spacing between adjacent coins in such an embodiment.

As the belt 522 continues to rotate, coins are moved past a coin discrimination sensor 540 for discriminating between invalid and valid coins and for determining the denomination of the coins. A plurality of coin exit channels 551–555 are disposed in the rail 520 downstream of the coin discrimination sensor 540. While five exit channels 551–555 are shown in the embodiment of the rail system 500 shown in FIG. 10, the length of the rail 510 and the endless belt 522 can be extended (or reduced) to accommodate any reasonable number of exit channels. Also included along the rail 510 are a plurality of diverting pins 560 disposed adjacent each coin exit channel 551–526 for obstructing a coin moving along the wall 520 and forcing the coin into the corresponding exit channel. The diverting pins 560 each move from a home position, wherein the pins disposed slightly below the surface 521 of the rail, to a diverting position extending beyond the surface 521 of the rail 510 for engagement with coins. Each of the diverting pins 560 are moved from the home position to the diverting position and back to the home position by a voice coil, which provides the advantage of rapid actuation.

Figure 12:
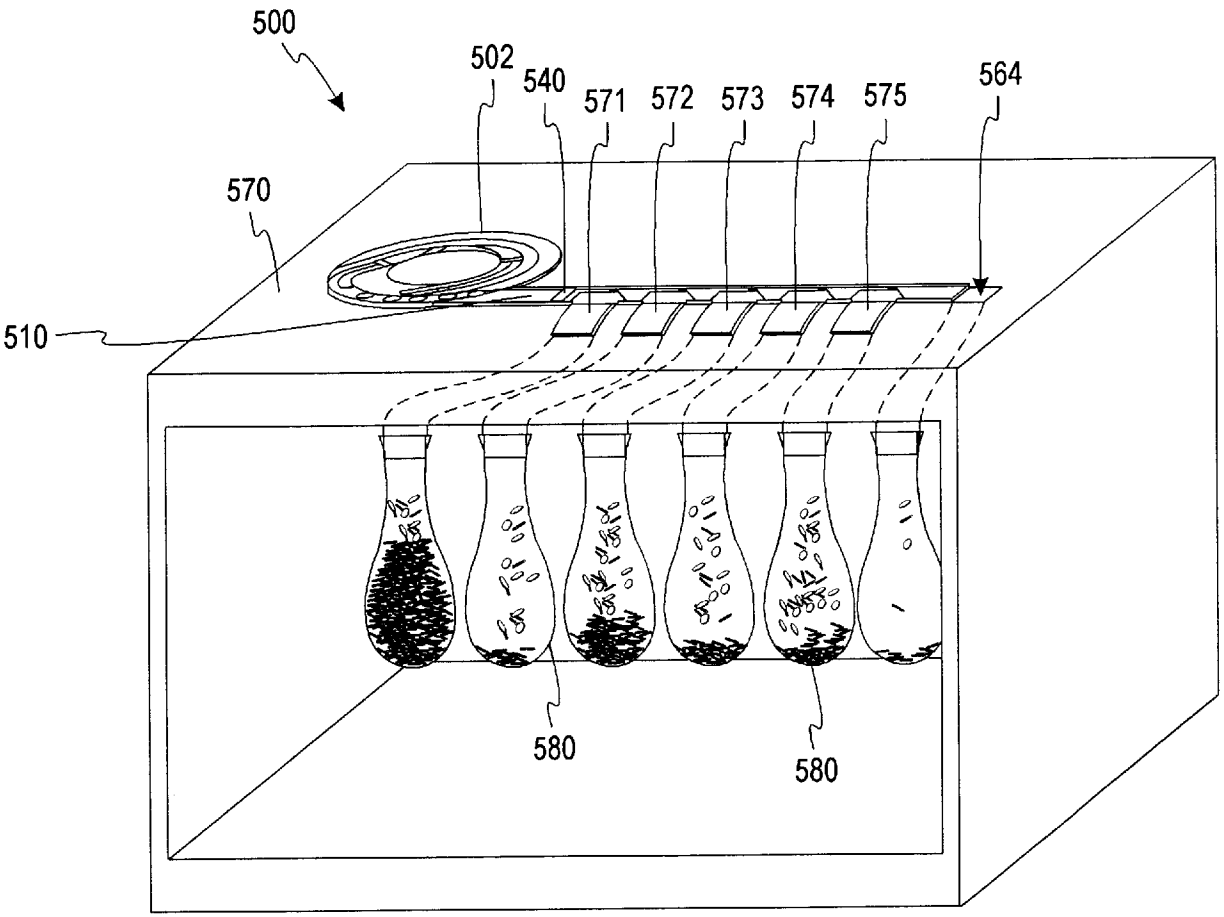
FIG. 12 is a perspective view of the programmable power rail coin processing system of FIG. 10 disposed within a cabinet according to one an alternative embodiment of the present invention.

An encoder (not shown) is coupled to one of the two pulleys 524, 526 and is interface with a controller of the rail system 500 for tracking the linear movement of the coins along the rail 510. As discussed above in connection with FIG. 8, the controller of the rail system 500 is interfaced with the coin discrimination sensor 540, the diverter pins 560 and the encoder for selectively diverting coins into the plurality of exit channel 551–555. Coins that are not selectively diverted into one of the plurality of exit channels 551–555 are moved off a downstream end 562 and fall into an invalid coin chute 564 (FIG. 12). Alternatively, invalid coins are off-sorted via one of the coin exit channels 551–555.

Similar to the sorting head depicted in FIG. 8, the rail system 500 is programmable. Each exit channel 551–555 is sized to accommodate coins of most any diameter. Accordingly, the rail sorter can be programmed to selectively discharge coins of any denomination out of any of the exit channels 551–555. For example, in one application, U.S. coins are sorted in order of increasing value—pennies, nickels, dimes, quarters, half dollar coins and dollar coins—rather than in order of increasing diameter.

Referring also to FIG. 12, the rail system 500 is disposed within a cabinet 570 for housing the rail sorter 500. (Note that the endless belt 522 and pulleys 524, 526 are not shown FIG. 12.) A plurality of coin tubes 571–575 are disposed along the rail 510 adjacent the exit channels 551–555 for receiving coins discharged from each of the exit channels 551–555 and routing the coins to coin receptacles such as coin bags 580 contained within the cabinet 570. A sixth coin tube 576 routs coins from the invalid coin chute 564 to a coin receptacle disposed with the cabinet 570.

The rail system 500 provides the advantage of presenting the coin bags 580 in a substantially liner fashion. Put another way, the exit channels 551–555 output coins in the same direction which facilities a substantially linear bag presentation. Therefore, an operator of the rail system 500 can easily access the coins bags 580 from the same side of the cabinet. In alternative embodiment of the rail sorter 500, dual coin bag holders for holding two coins bags can be attached to the end of each coin tube. Dual bag holders allow the rail system 500 to route coins of a single denomination to two different bags; thus, once a predetermined number of coins have been routed to a first bag the coins of that denomination are routed to a second bag.

In an alternative embodiment of the rail system 500, the guide plate 502 includes a discrimination region having a discrimination sensor and a reject channel as does the sorting head 112 of FIG. 2. Accordingly, the discrimination sensor on the guide plate 502 discriminates between valid and invalid coins and/or determines the denomination of the coins and invalid coins are off-sorted via the reject channel. Thus, no discrimination sensor is needed on the rail in such an embodiment.

In yet another alternative embodiment of the rail system, the rail and guide plate are formed from the same piece of material such that they are integral components. The rotating pad and endless belt are disposed on the same side of the integral rail and pad—either the top-side or the bottom-side. Alternatively still, a large rotating pad can impart movement to the coins along the integral guide plate and pad.

Figure 13:
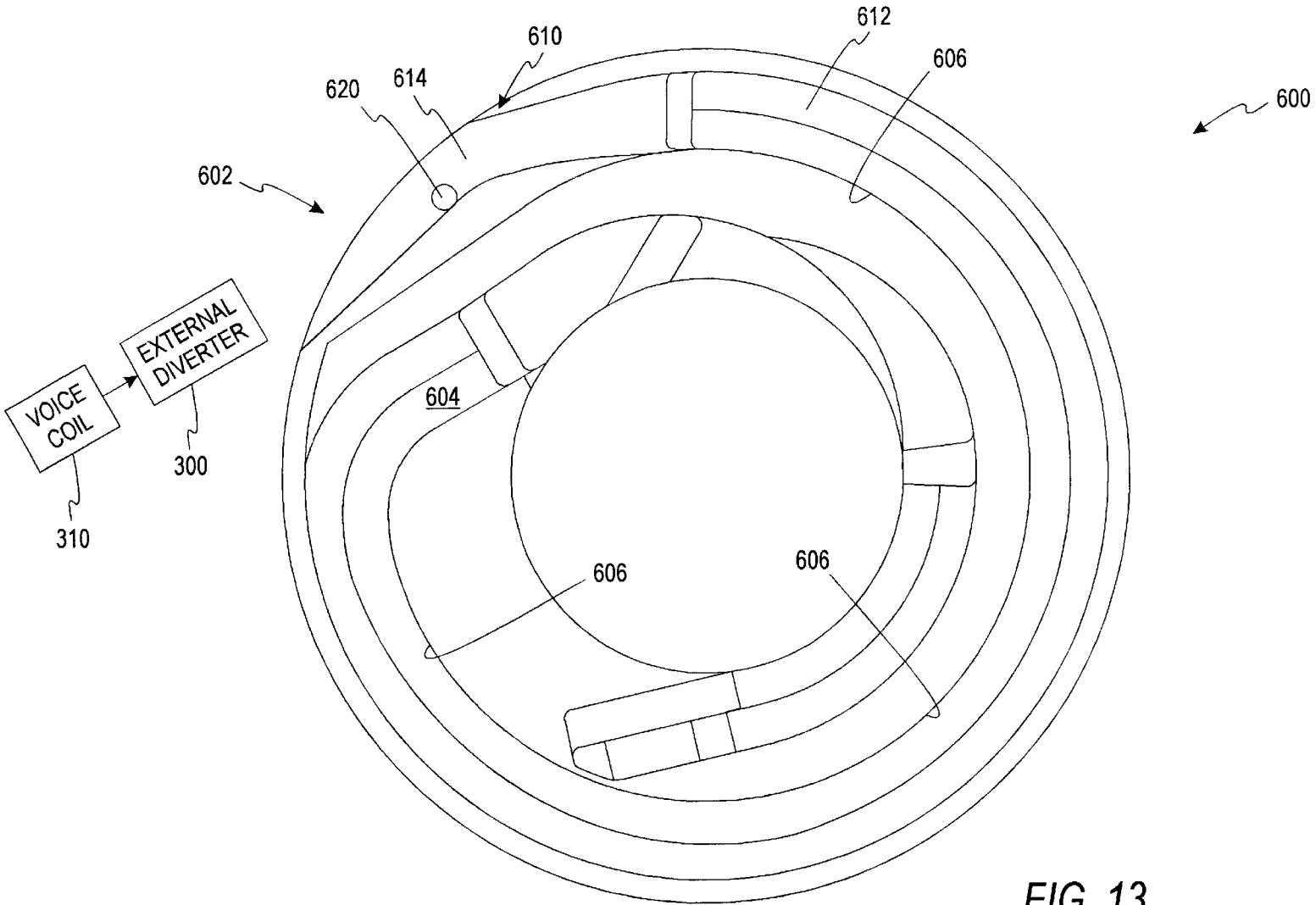
FIG. 13 is an enlarged bottom view of a sorting head having a single coin exit station that can be used with the coin processing system of FIG. 1 instead of the sorting head shown in FIG. 2.

Turning to FIG. 13, a sorting head 600 having a single exit station 602 is shown for use in an alternative embodiment of the coin processing system 100. The sorting head 600 operates in a similar manner as does the sorting heads described previously up until the point where the coins enter a queuing region 604 of the sorting head 600. In the queuing channel 604, the coins are aligned against an inner queuing wall 606, which extends around a substantial portion of the sorting head 600. At the downstream end, the queuing channel 604 includes a substantially "dog-leg-shaped" portion 610, which includes an first upstream segment 612 and a second downstream segment 614.

Similar to the generally L-shaped queuing regions described above in connection with FIGS. 2 and 8, the dog-leg-shaped portion 610 imparts a spacing to adjacent coins moving from the first segment 612 to the second downstream segment 614. As a pad (such as pad 118 of FIG. 1) rotates, the coins are pushed against inner wall 606 and travel along the inner wall 606 in a direction that is transverse to the direction in which the pad is rotating. This action aligns the coin against the wall 606. As the coins move from the first upstream segment 612 to the second downstream segment 614 of the queuing channel 166, the coins are turned in a direction wherein they are moving with the pad, which imparts spacing between adjacent coins.

As the pad continues to rotate, the coins are moved past a discrimination sensor 620 disposed along the queuing channel 604 for discriminating between valid and invalid coins and/or identifyng the denomination of coins. The coins continue along the inner queuing channel wall 606 until the pad rotation causes the coins to be discharged from the single exit station 602. Note that that all coins entering the coin processing system described in connection with FIG. 13 thus far are discharged out of the single output channel 602.

An external diverter 300 actuated by a voice coil 310, such as described in connection with FIGS. 7*a,b*, receives coins discharged from the single output receptacle 602. A controller (not shown) monitors the output of the discrimination sensor 620 for selectively moving the internal partition 304 (FIGS. 7*a,b*) between the first and second positions 308*a,b* for routing coins to the first and second coins paths 310*a,b*. Alternatively, the external diverter is actuated by a solenoid.

The coin processing system described in connection with FIG. 13 can be used in applications wherein it is desirable to separate coins into two batches. For example, it may be desired to process U.S. dimes into batches of 1000 dimes each. In another application, it may be desired to separate valid coins from invalid coins. In another application, it may be desired to separate a mixed batch of coins such as a mix of U.S. coins and Euro coins into their respective coin sets. According to an alternative embodiment of the coin processing system described in connection with FIG. 13, the sorting head 600 includes a diverting pin and reject channel for off-sorting invalid coins prior to discharging valid coins from the single exit station 602. Such an embodiment can be used in an application wherein it is desired to separate Euro coins from U.S. coins, but to also remove invalid coins (e.g, coins from other coin sets and/or counterfeit coins).

While the invention is susceptible to various modifications and alternative forms, specific embodiments have been shown by way of example in the drawings and described in detail herein. It should be understood, however, that the invention is not intended to be limited to the particular forms disclosed. Rather, the invention is to cover all modifications, equivalents and alternatives falling within the spirit and scope of the invention as defined by the appended claims.

What is claimed is:

1. A coin processing system for processing a plurality of coins of mixed denominations, comprising:

a rotatable disc for imparting motion to the plurality of coins;

a sensor for differentiating between a valid and invalid coins;

a stationary sorting head having a lower surface generally parallel to and spaced slightly away from the rotatable disc, the lower surface forming a queuing channel and a plurality of exit channel for sorting and discharging coins of particular denominations, the queuing channel having a first segment for receiving coins and a second segment for moving the coins past the sensor, the queuing channel being configured to move coins at a faster rate along the second segment for increasing the spacing between adjacent coins;

a diverter disposed along the second segment beyond the sensor, the diverter being moveable between a first position permitting coins to proceed to the plurality of exit channels and a second position for diverting coins to a reject; and a controller for moving the diverter from the first position to the second position when the sensor detects an invalid coin.

2. The coin processing system of claim 1, wherein the reject region includes a reject slot into which coins a diverted by the diverter.

3. The coin processing system of claim 2, wherein the reject slot leads coins to a periphery of the sorting head.

4. The coin processing system of claim 1, wherein the coin are aligned along an inner wall of the second segment of the queuing channel, the diverter being disposed immediately adjacent to the inner wall for causing coins to be diverted away from the inner wall and toward the reject region.

5. The coin processing system of claim 1, wherein the diverter includes a voice coil for high speed activation.

6. The coin processing system of claim 1, wherein the queuing channel includes an inner wall against which the coins abut and has, in a cross-sectional view, a stepped profile that defines a first edge and a second edge, the first edge being closer to the inner wall than the second edge.

7. The coin processing system of claim 6, wherein inner edges of the coins engage the inner wall, coins of a smaller diameter engaging the first edge, coins of a larger diameter engaging the second edge.

8. The coin processing system of claim 7, wherein the coins remain under pressure between the rotatable disc and the sorting head while moving along the first edge and the second edge.

9. The coin processing system of claim 6, wherein the stepped profile of the queuing channel transitions to a substantially flat profile.

10. The coin processing system of claim 1, wherein the diverter is actuated by a solenoid.

11. The coin processing system of claim 1, wherein the queuing channel is generally L-shaped.

12. The coin processing system of claim 1, wherein the first segment is disposed at an angle of 90 degrees to about 110 degrees relative to the second segment.

13. The coin processing system of claim 12, wherein the angle is about 100 degrees.

14. A method for processing coins, comprising:

receiving coins in a coin receiving area;

moving coins along a queuing region after the coin receiving area, the queuing region including a first segment and a second segment of the queuing region;

creating additional spacing between adjacent coins as the coins transition from the first segment to the second segment;

determining the authenticity of each of the coins passing through the second segment; and diverting non-authentic coins away from a coin path leading to a discharge region for authentic coins at a point upstream from the discharge region;

wherein moving, creating, determining, and diverting are performed while the coins are located between a rotatable disc and a stationary sorting head.

15. The method of claim 14, wherein the diverting includes activation a voice coil in response to the step of determining.

16. The method of claim 14, wherein the creating additional spacing includes moving coins along the second segment at a higher rate of speed.

17. The method of claim 14, wherein the discharge region includes a plurality of coin exit channels, the method further including the step of sorting coins of each denomiantion into a corresponding one of the plurality of coin exit channels.

18. The method of claim 17, wherein the plurality of coin exit channels are of different dimensions.

19. The method of claim 14, wherein the step of diverting occure along the second segment.

20. The method of claim 14, wherein the coins being processed move at a constant operational speed during the steps of determining and diverting.

21. A method for processing coins, comprising;

receiving coins in a coin receiving region;

imparting motion to the coins with a rotatable disc;

engaging the coins with a stationary sorting head during the step of imparting motion;

increasing the spacing between adjacent coins in a queuing region of the sorting head;

determining the authenticity of each of the coins after the step of increasing the spacing;

diverting non-authentic ones of the coins to a coin reject region; and moving authentic ones of the coins to a coin discharge region at a location that is beyond the coin reject region.

22. The method of claim 21, wherein the queuing region includes a first segment and a second segment, the second segment being arranged in a position on the sorting head that is more in alignment with the direction of movement of the rotatable disc than the first segment, the second segment providing the step of increasing the spacing between adjacent coins.

23. The method of claim 21, wherein the first segment is disposed at an angle of about 90 degrees to about 110 degrees relative to the second segment.

24. The method of claim 23 wherein the angle is about 100 degrees.

25. The method of claim 21, wherein the diverting includes activating a voice coil in response to the step of determining.

26. The method of claim 21, wherein the diverting includes activating a solenoid in response to the step of determining.

27. The method of claim 21, wherein the step of moving authentic ones of the coins occurs while the coins are under pressure between the rotatable disc and the sorting head.

28. The method of claim 21, wherein the step of determining occurs within the queuing region.

29. A coin processing system for processing a plurality of coins of mixed denominations, comprising:

a rotatable disc for imparting motion to the plurality of coins;

a stationary sorting head having a lower surface generally parallel to and spaced slightly away from the rotatable disc, the lower surface of the sorting head forming a queuing channel and at least one coin exit channel for dischargeing coins, the queuing channel having a first segment for receiving coins from an input coin region and a second segment disposed in a position that is substantially more in direction of movement of the rotatable disc positioned immediately thereunder than the first segment to create an increased spacing between adjacent coins as the coins move toward the at least one exit channel;

a sensor disposed along the at least one coin exit channel for differentiating between valid and invlaid coins as each of the coins pass through the at least one coin exit channel;

at least one diverter disposed outisde the periphery of the sorting head for receiving coins discharged from the at least one coin exit channel, the diverter being movable between a first position for directing coins into a first area and a second position for directing coins into a second area; and a controller for controlling the movement of the at least one diverter and the movement of the rotatable disc, the controller causing the diverter to move to the first position when a coin is determined to be valid, the controller causing the diverter to move to the second position when a coin is determined to be invalid, wherein the increased spacing between adjacent coins permits the controller to maintain the rotatable disc at a substantially constant operating speed when causing the diverter to move between the first position and the second position.

30. The coin processing system of claim 29, wherein the diverter includes a voice coil providing high-speed switching between the first position and the second position, the voice coil providing a force in both directions of movement toward the first and second positions.

31. The coin processing system of claim 30, wherein the voice coil provides at least about 20 pounds of force in both directions.

32. The coin processing system of claim 30, wherein the voice coil undergoes a displacement of at least about ⅛ inch in about 1.3 milliseconds.

33. The coin processing system of claim 30, wherein the voice coil provides high-speed switching at a speed of at about 0.1 inch per millisecond.

34. The coin processing system of claim 30, wherein the voice coil maintains a diverting structure at the first position until activation to the second position is necessary and maintains the diverting structure at the second position until activation to the first position is necessary.

35. The coin processing system of claim 29, wherein the at least one exit channel is exactly one exit channel.

36. The coin processing system of claim 29, wherein the first segment is disposed at an angle of about 90 degrees to about 110 degrees relative to the second segment.

37. The coin processing system of claim 36, wherein the angle is about 100 degrees.

38. The coin processing system of claim 29, wherein the quening channel is generally L-shaped.

39. The coin processing system of claim 29, wherein the diverter includes a solenoid for switching between the first position and the second position.

40. A coin processing system for processing a plurality of coins of mixed denominations, comprising:

a rotatable disc for imparting motion to the plurality of coins;

a sensor for differentiating between valid and invalid coins;

a stationary sorting head having a lower surface generally parallel to and spaced slightly away from the rotatable disc, the lower surface of the sorting head forming a queuing channel and two coin exit stations for receiving coins having different characteristics, the queuing channel having a first segment for receiving coins from an input coin region and a second segment disposed in a position that is substantially more in direction of movement of the rotatable disc positioned immediately thereunder than the first segment to create an increased spacing between adjacent coins;

a sensor disposed along the queuing channel for obtaining information from each of the coins for differentiating between valid and invalid coins as the coins move through the queuing channel;

a diverter disposed at an end of the second segment for directing coins between the two exit stations based on information obtained by the sensor, the diverter moving at a rate that allows the rotatable disc to maintain a substantially constant operational speed while the diverter directs coins between the two exit stations.

41. The coin processing system of claim 40, wherein the sensor is located at a beginning portion of the second segment.

42. The coin processing system of claim 40, wherein the first and second exit stations are first and second exit channels, respectively, the first exit channel being in general alignment with the second segment of the queuing channel, the diverter directing coins away from the first exit channel and into the second exit channel.

43. The coin processing system of claim 40, wherein the first and second exit stations are located at an end portion of an exit channel, the diverter being at the end portion of an exit channel and deflecting coins toward one of the first and second exit stations.

44. The coin processing system of claim 40, wherein the diverter includes a voice coil providing high-speed switching between the first position and the second position, the voice coil providing a force in both directions of movement toward the first and second positions.

45. The coin processing system of claim 44, wherein the force is at least about 20 pounds of force in both directions.

46. The coin processing system of claim 45, wherein the voice coil undergoes a displacement of at least about ⅛ inch in about 1.3 milliseconds.

47. The coin processing system of claim 40, wherein the characteristics include metal content, thickness and diameter.

48. The coin processing system of claim 47, wherein the coin processing system discriminates between two coin sets, each coin set being distributed to a corresponding one of the two exit stations.

49. The coin processing system of claim 48, further including a controller for determining a value of each coin set that is distributed to the two exit stations.

50. The coin processing system of claim 40, wherein the first segment is disposed at an angle of about 90 degrees to about 110 degrees relative to the second segment.

51. The coin processing system of claim 50, wherein the angle is about 100 degrees.

52. The coin processing system of claim 40, wherein the queuing channel is generally L-shaped.

53. The coin processing system of claim 40, wherein the diverter include solenoid for switching between the first position and the second position.

54. A coin processing system for processing a plurality of coins of mixed denominations, comprising:

a rotatable disc for imparting motion to the plurality of coins;

a stationary sorting head having a lower surface generally parallel to and spaced slightly away from the rotatable disc, the lower surface of the sorting head forming a queuing channel and an exit channel for receiving the coins, the queuing channel having a first segment for receiving coins from an input coin region and a second segment disposed in a position that is substantially more in direction of movement of the rotatable disc positioned immediately thereunder than the first segment to create an increased spacing between adjacent coins;

a discrimination sensor disposed along the queuing channel for detecting characteristics of the coins moving through the queuing channel;

a diverter disposed outside the periphery of the sorting head in a path of the coin exit channel for receiving coins discharged from the corresponding exit channel, the diverter being movable between a first position for receiving the coins having a certain characteristic detected by the discrimination sensor and a second position for receiving all other coins, the diverter moveable between the first and the second position in a time that is less than the time required for a coin to move a distance corresponding to the increased spacing.

55. The coin processing system of claim 54, wherein the diverter includes a voice coil for providing high-speed switching between the first position and the second position, the voice coil providing a force in both directions of movement toward the first and second positions.

56. The coin processing system of claim 55, wherein the force is at least about 20 pounds of force in both directions.

57. The coin processing system of claim 55, wherein the voice coil undergoes a displacement of at least about ⅛ inch in about 1.3 milliseconds.

58. The coin processing system of claim 55, wherein the voice coil maintains a diverting structure at the first position until activation to the second position is necessary and maintains the diverting structure at the second position until activation to the first position is necessary.

59. The coin processing system of claim 54, wherein the diverter includes a solenoid for moving the diverter between the first position and the second position.

60. The coin processing system of claim 55, wherein the rotatable disc includes a pad and the coins are under pad pressure while moving past the discrimination sensor.

61. The method of claim 54, wherein the first segment is disposed at an angle of about 90 degrees to about 110 degrees relative to the second segment.

62. The method of claim 61 wherein the angle is about 100 degrees.

63. The coin processing system of claim 54, wherein the queuing channel is generally L-shaped.

64. A coin processing machine for processing a plurality of coins of mixed denominations, comprising:

a rotatable disc for imparting motion to the plurality of coins;

a stationary sorting head having a lower surface generally parallel to and spaced slightly away from the rotatable disc, the lower surface forming a queuing channel and a coin exit station, the queuing channel having an interior wall against which the coins abut, the queuing channel having a first segment for receiving coins and aligning the coins along the interior wall and a second segment for moving the coins to an outer periphery of the sorting head such that a portion of each coin extends beyond the outer periphery;

an optical sensor disposed outside the periphery of the sorting head for obtaining optical information from the portion of each coin extending beyond the periphery of the sorting head;

a diverter disposed toward an end of the second segment, the diverter being moveable between a first position wherein coins remain along a coin path toward the coin exit station and a second position for diverting coins to a reject station; and a controller for moving the diverter from the first position to the second position in response to the optical information obtained by the optical sensor indicating a coin should not proceed to the coin exit station.

65. The coin processing machine of claim 64, wherein the second segment creates an increased spacing between adjacent coins.

66. The coin processing machine of claim 64, wherein the information from the optical sensor determines the authenticity of each coin.

67. The coin processing machine of claim 66, wherein the optical information from the optical sensor determines the denomination of each coin.

68. The coin processing machine of claim 64, wherein the information from the optical sensor determines the denomination of each coin.

69. The coin processing machine of claim 64, wherein the exit station includes a plurality of exit channels for sorting coins into particular denominations.

70. The coin processing machine of claim 64, wherein the sorting head includes a gauging channel for aligning coins along a common radius prior to the plurality of exit channels.

71. The coin processing machine of claim 64, wherein the diverter includes a voice coil.

72. The coin processing machine of claim 64, wherein the diverter includes a solenoid.

73. The coin processing machine of claim 64, wherein the reject station includes a reject slot leading from the diverter to a periphery of the sorting head.

74. The coin processing machine of claim 64, wherein the first segment is disposed at an angle of about 90 degrees to about 110 degrees relative to the second segment.

75. The coin processing machine of claim 74 wherein the angle is about 100 degrees.

76. The coin processing machine of claim 64, wherein the queuing channel is generally L-shaped.

77. A coin processing machine for processing a plurality of coins of mixed denominations, comprising:

a rotatable disc for imparting motion to the plurality of coins;

a stationary sorting head having a lower surface generally parallel to and spaced slightly away from the rotatable disc, the lower surface forming a coin path leading to a coin exit station at which coins are discharged, the coin path moving the coins toward an outer periphery such that a portion of each coin extends beyond the outer periphery;

an optical sensor for obtaining optical information from the portion of each coin extending beyond the outer periphery;

a diverter disposed downstream of the optical sensor, the diverter being moveable between a first position allowing coins to remain on the coin path and a second position for diverting coins toward a reject station; and a controller for moving the diverter from the first position to the second position in response to the optical information obtained by the optical sensor indicates a certain coin should not proceed to the coin exit station.

78. The coin processing machine of claim 77, wherein the exit station includes a plurality of exit channels for sorting coins into particular denominations.

79. The coin processing machine of claim 78, wherein the sorting head includes a gauging channel for aligning coins along a common radius prior to the plurality of exit channels.

80. The coin processing machine of claim 77, wherein the optical information from the optical sensor determines the authenticity of each coin.

81. The coin processing machine of claim 80, wherein the information from the optical sensor determines the denomination of each coin.

82. The coin processing machine of claim 77, wherein the information from the optical sensor evaluates the authenticity of each coin.

83. The coin processing machine of claim 77, wherein the reject station includes a reject slot leading from the diverter to a periphery of the sorting head.

84. The coin processing machine of claim 77, wherein the diverter includes a voice coil.

85. The coin processing machine of claim 77, wherein the diverter includes a solenoid.

86. The coin processing machine of claim 77, wherein the sorting head provides for an increased spacing between adjacent coins before the coins encounter the sensor.

87. The coin processing machine of claim 86, wherein the coin path includes a queuing region having a first and second segment, the second segment being positioned in a direction that is more in alignment with a direction of movement of the rotatable disc, the transition between the first segment and the second segment providing the increased spacing.

88. The coin processing machine of claim 87, wherein the first segment is disposed at an angle of about 90 degrees to about 110 degrees relative to the second segment.

89. The coin processing machine of claim 88, wherein the angle is about 100 degrees.

90. The coin processing system of claim 87, wherein the queuing channel is generally L-shaped.

91. A method of processing coins, comprising:

receiving the coins in a coin receiving region;

imparting motion to the coins with a rotatable disc;

engaging the coins with a stationary sorting head during the step of imparting motion;

moving coins along a coin path within the stationary sorting head, a portion of the coin path being adjacent to a periphery of the sorting head causing a portion of each coin to be exposed outside of the sorting head;

optically sensing the portion of each coin while exposed outside of the sorting head; and moving at least some of the coins to a coin exit station after optical sensing.

92. The method of claim 91, wherein the sensing includes determining the authenticity of each of the coins.

93. The method of claim 91, further including diverting non-authentic ones of the coins to a coin reject region after the step of sensing.

94. The method of claim 91, further including sorting authentic ones of the coins in a plurality of coin exit channels located within the coin exit station.

95. The method of claim 91, further including increasing the spacing between adjacent coins prior to the step of sensing.

96. The method of claim 91, wherein the step of sensing includes determining the denomination of each coin.

97. The method of claim 91, wherein less than half a diameter of each of the coins is exposed.

98. A coin processing machine for processing a plurality of coins of mixed denominations, comprising:

a rotatable disc for imparting motion to the plurality of coins;

a stationary sorting head having a lower surface generally parallel to and spaced slightly away from the rotatable disc, the lower surface of the sorting head having formed therein a gauging channel for aligning the coins along a common radius and a plurality of exit channels for discharging coins, the gauging channel having an interior wall against which the coins abut, each of the exit channels having substantially the same width;

a sensor for obtaining information indicative of the denomination of each of the coins from each of the coins;

a plurality of diverters disposed along the interior wall of the gauging channel, each of the plurality of diverters corresponding to one of the plurality of exit channels, each of the plurality of diverters being movable between a first position wherein coins remain abutted against the interior and a second position wherein coins are diverted to the corresponding exit channel; and a controller for selectively controlling the movement of each of the diverters between the first and second positions in response to input from the sensor.

99. The coin processing machine of claim 98, wherein the sorting head includes a coin reject station with an associated diverter, the coin reject station being adjacent to the sensor.

100. The coin processing machine of claim 99, wherein the sensor determines the authenticity of each of the coins, non-authentic ones of the coins being diverted to the coin reject station.

101. The coin processing machine of claim 98, wherein each of the plurality of diverters includes a voice coil for providing high-speed diverting.

102. The coin processing machine of claim 98, wherein each of the coins remains entirely sandwiched between the sorting head and the rotatable disc prior to being diverted by one of the diverters.

103. The coin processing machine of claim 98, wherein the sorting head includes a queuing region for increasing the spacing between adjacent the coins.

104. The coin processing machine of claim 103, wherein the sensor is located within the queuing region at a point after the spacing between adjacent coins has been increased.

105. The coin processing machine of claim 98, wherein the coins remain under pressure between the rotatable disc and the stationary sorting head while within the gauging channel.

106. The coin processing machine of claim 98, wherein each of the plurality of diverters is a peg-like structure extending downwardly from openings within the sorting head.

107. A coin processing system for processing a plurality of coins of mixed denominations, comprising:

a rotatable disc for imparting motion to the plurality of coins;

a stationary sorting head having a lower surface generally parallel to and spaced slightly away from the rotatable disc, the lower surface of the sorting head having formed therein a gauging channel for aligning the coins in a certain formation and a plurality of exit channels for discharging coins at spaced circumferential locations along the sorting head, each of the coin exit channels capable of receiving each coin in a coin set;

a sensor for determining the denomination of each of the coins; and a plurality of diverters disposed along the gauging channel, each of the plurality of diverters corresponding to one of the plurality of coin exit channels, each of the plurality of diverters being movable between a first position wherein coins remain in movement along the gauging channel and a second position wherein coins are diverted into the corresponding exit channel.

108. The coin processing system of claim 107, wherein the sorting head includes a coin reject station with an associated diverter, the coin reject station being adjacent to the sensor.

109. The coin processing system of claim 108, wherein the sensor determines the authenticity of each of the coins, non-authentic ones of the coins being diverted to the coin reject station.

110. The coin processing system of claim 107, wherein each of the exit channels is dimensionally same.

111. The coin processing system of claim 107, wherein the gauging region aligns the coins along a common radius.

112. The coin processing system of claim 107, wherein each of the plurality of diverters includes a voice coil for providing high-speed diverting.

113. The coin processing system of claim 107, wherein each of the coins remains entirely sandwiched between the sorting head and the rotatable disc prior to being diverted by one of the diverters.

114. The coin processing system of claim 107, wherein the sorting head includes a queuing region for increasing the spacing between adjacent the coins.

115. The coin processing system of claim 114, wherein a portion of the queuing region is generally L-shaped for imparting spacing between each coin.

116. The coin processing system of claim 107, further including an encoder coupled to the controller for tracking the position of each coin sensed by the sensor.

117. A method of processing coins, comprising:

receiving the coins in a coin receiving region;

imparting motion to the coins with a rotatable disc;

engaging the coins with a stationary sorting head during the step of imparting motion;

moving coins along a coin path within the stationary sorting head;

actuating a single sensor that determines the authenticity of each coin and the denomination of each coin;

tracking the position of each coin that has been sensed by the single sensor; and selectively actuating a plurality of diverters to discharge certain denominations of the coins into corresponding exit stations.

118. The method of claim 117, further including diverting non-authentic ones of the coins to a reject station.

119. The method of claim 117, further including increasing the spacing between adjacent coins prior to actuating the single sensor.

120. The method of claim 117, further including determining a value of authentic ones of the coins that have been sensed.

121. The method of claim 117, wherein the step of selectively actuating the plurality of diverters includes the step of selectively actuating a series of voice coils.

122. A method of processing coins, comprising:

moving coins along a coin path within a stationary sorting head;

actuating a single sensor that determines the denomination of each coin;

tracking the position of each coin that has been sensed by the single sensor; and selectively actuating a plurality of diverters to discharge certain denominations of the coins into corresponding exit stations.

123. A coin processing system for processing a plurality of coins of mixed denominations, comprising:

a coin driving member for imparting motion to the plurality of coins so that the coins move along a certain coin path;

at least one coin exit station along the coin path;

a diverting structure for diverting the coin from the coin path to the coin exit station; and a voice coil mechanically coupled to the diverting structure for providing movement to the diverting structure.

124. The coin processing system of claim 123, further including a plurality of diverters disposed along the coin path, each of the plurality of diverters having a corresponding voice coil mechanically coupled thereto.

125. The coin processing system of claim 123, wherein the coin path is curved.

126. The coin processing system of claim 123, wherein the coin path is straight.

127. The coin processing system of claim 123 , wherein the coin driving member is a rotatable disc.

128. The coin processing system of claim 127, further including a stationary sorting head for defining the coin path.

129. A programmable rail coin processing system for processing a plurality of coins of mixed denominations, comprising:

a rotatable disc for imparting motion to the plurality of coins;

a stationary guide plate head having a lower surface generally parallel to and spaced slightly away from the rotatable disc, the lower surface forming a queuing channel and a exit station, the queuing channel having an interior wall against which coins abut when moving toward the exit station, the queuing channel having a first segment for receiving coins from an input coin region and a second segment disposed in a position that is substantially more in direction of movement of the rotatable disc positioned thereunder than the first segment to create an increased spacing between adjacent coins;

a rail for receiving coins from the exit station, the rail having a wall against which coins abut when moving toward a plurality of exit channel for discharging coins;

a driven endless belt disposed above and spaced slightly from the rail for imparting movement to the coin received by the rail a diverter corresponding to each of the plurality each exit channels of the rail for diverting coins from the wall into the plurality of exit channels;

a sensor disposed upstream of the plurality of exit channels obtain information from each of the coins for differentiating between valid and invalid coins; and a controller for selectively activating each of the diverting structures.

130. The system of claim 129, wherein each of the diverters have a corresponding voice coil mechanically coupled thereto for actuating the diverter.

131. The system of claim 129, wherein each of the diverters have a corresponding solenoid mechanically coupled thereto for actuating the diverter.

132. The system of claim 129, wherein the first segment is disposed at an angle of about 90 degrees to about 110 degrees relative to the second segment.

133. The system of claim 132, wherein the angle is about 100 degrees.

134. The system of claim 129, wherein the queuing channel is generally L-shaped.

135. The system of claim 129, wherein the plurality of exit channels are linearly aligned along the rail.

136. The system of claim 129, wherein the plurality of exit channels discharge coins from a common side of the rail.

137. The system of claim 129, further comprising at least one coin bag per exit channel for receiving coins from each of the exit channels, the bags being arranged in a substantially linear presentation.

138. A coin processing system for processing a plurality of coins of mixed denominations, comprising:

a rotatable disc for imparting motion to the plurality of coins;

a stationary sorting head having a lower surface generally parallel to and spaced slightly away from the rotatable disc, the lower surface forming a queuing channel and a plurality of exit channels for sorting and discharging coins, the queuing channel having an interior wall against which coins abut when moving toward the exit channels, the queuing channel having a first segment for receiving coins from an input coin region and a second segment disposed in a position that is substantially more in direction of movement of the rotatable disc positioned thereunder than the first segment to create an increased spacing between adjacent coins, the discriminator being located in the queuing channel, the lower surface having a reject region between the first segment of the queuing channel and the plurality of exit channels;

a sensor for obtaining characteristic information from each of the coins, the sensor producing a signal indicative of the obtained information;

a diverting pin disposed toward an end of the second segment, the diverter being moveable between a first position wherein coins remain abutted against the wall for proceeding toward the plurality of exit channels and a second position for diverting coins away from the interior wall to the reject region;

a voice coin mechanically coupled to the diverting pin for rapidly moving the diverting pin from the first position to the second position and from the second position to the first position;

a memory for storing master characteristic information obtained from known genuine coins; and a controller electrically coupled to the sensor and the voice coils, the controller adapted to compare the denominating characteristic information obtained from each of the coins to the master denomination characteristic information stored in memory, the controller actuating the voice coil when the obtained information does not favorably compare to master information corresponding to a group of valid coins.

139. The coin processing system of claim 138, further including a gauging channel for aligning outer edges of the coins along a gauging wall immediately prior to the at least two exit channels.

140. The coin processing system of claim 139, further including a transition area between the gauging channel and the queuing channel to allow coins to move from an interior wall within the queuing channel to the gauging wall within the gauging channel.

141. The coin processing system of claim 140, wherein the coins are under pressure between the rotatable disc and the sorting head when moving through the transition area.

142. The coin processing system of claim 140, wherein the coins are under no pressure when moving through the transition area.

143. The coin processing system of claim 138, wherein the reject region includes a reject slot into which coins are diverted by the diverter.

144. The coin processing system of claim 143, wherein the reject slot leads coins to a periphery of the sorting head.

145. The coin processing system of claim 143, wherein the reject slot has a length of no more than about three times the diameter of the smallest authentic coin to be processed.

146. The coin processing system of claim 145, wherein inner edges of the coins engage the inner wall, coins of a smaller diameter engaging the first edge, coins of a larger diameter engaging the second edge.

147. The coin processing system of claim 146, wherein the coins remain under pressure between the rotatable disc and the sorting head while moving along the first edge and the second edge.

148. The coin processing system of claim 138, wherein the rotatable disc includes a pad, the coins being under pad pressure when moving through the queuing channel.

149. The coin processing system of claim 138, wherein the queuing channel includes an inner wall against which the coins abut and has, in a cross-sectional view, a stepped profile that defines a first edge and a second edge, the first edge being closer to the inner wall than the second edge.

150. The coin processing system of claim 138, wherein the queuing channel terminates at a location adjacent to a periphery of the rotatable disc.

151. The coin processing system of claim 138, wherein the controller determines the denomination of each authentic coin, the controller determining the value of the coins being processed based on input from the sensor.

152. The coin processing system of claim 151, wherein the controller maintains a count of the number of coins discharged from each exit channel.

153. The coin processing system of claim 151, further including a counting sensor in each of the exit channels, the counting sensor being coupled to the controller, the controller determining the value of the coins being processed based on inputs received from the counting sensors.

154. The coin processing system of claim 138, further including a trigger sensor positioned immediately upstream from the sensor, the sensor being activated to determine characteristics of a particular coin in response to the expiration of a certain time period occurring after the trigger sensor detects the particular coin.

155. The coin processing system of claim 138, wherein the coins are aligned along an inner wall of the second segment of the queuing channel, the diverting pin being immediately adjacent to the inner wall for causing coins to be diverted away from the inner wall and toward the reject region.

156. The coin processing system of claim 155, wherein the second segment of the queuing channel includes a coin engaging surface immediately adjacent to the inner wall, the reject region including a reject slot that is immediately adjacent to the coin engaging surface.

157. The coin processing system of claim 156, wherein the coin engaging surface has a width measured in a radial direction that is approximately the width of the diverter when the diverter is in the second position.

158. The coin processing system of claim 156, wherein the diverting pin is a diverting pin that protrudes downwardly from the coin engaging surface.

159. The coin processing system of claim 138, wherein the discriminator determines a metal content and a dimension of the coins.

160. The coin processing machine of claim 138, wherein the first segment is disposed at an angle of about 90 degrees to about 110 degrees relative to the second segment.

161. The coin processing system of claim 160, wherein the angle is about 100 degrees.

162. The coin processing system of claim 138, wherein the queuing channel is generally L-shaped.

163. A method for processing coins, comprising:

receiving coins in a coin receiving area;

imparting motion to the received coins to move coins along a queuing region, the queuing region including a first segment and a second segment of the queuing region;

creating additional spacing between adjacent coins as the coins transition from the first segment to the second segment;

determining whether of each of the coins passing through the second segment are valid coins or invalid coins; and diverting invalid coins away from a coin path leading to a discharge region for valid coins.

164. The method of claim 163 wherein imparting, creating, determining, and diverting are performed while the coins are located between a rotatable disc and a stationary sorting head.

165. The method of claim 163 wherein the diverting includes activating a voice coil in response to the step of determining.

166. The method of claim 163 wherein the creating additional spacing includes moving coins along the second segment at a higher rate of speed.

167. The method of claim 163 wherein the step of diverting occurs along the second segment.

168. The method of claim 163 wherein the discharge region includes a plurality of coin exit channels, the method further including the step of sorting coins of each denomination into a corresponding one of the plurality of coin exit channels.

169. The method of claim 168 wherein the plurality of coin exit channels are of different dimensions.

170. The method of claim 169 wherein the coins being processed move at a constant operational speed during the steps of determining and diverting.

171. A coin processing system for processing a plurality of coins of mixed denominations, comprising:

a rotatable disc for imparting motion to the plurality of coins;

a stationary sorting head having a lower surface generally parallel to and spaced slightly away from the rotatable disc, the lower surface forming a queuing channel and at least two exit channels for sorting and discharging coins, the queuing channel having an interior wall against which coins abut when moving toward the exit channels, the queuing channel having a first segment for receiving coins from an input coin region and a second segment disposed in a position that is substantially more in direction of movement of the rotatable disc positioned thereunder than the first segment to create an increased spacing between adjacent coins, the lower surface having a reject region between the first segment of the queuing channel and the plurality of exit channels;

a sensor for differentiating between valid and invalid coins, the sensor being located in the queuing channel;

a diverter disposed toward an end of the second segment, the diverter being moveable between a first position wherein coins remain abutted against the wall for proceeding toward the at least two exit channels and a second position for diverting coins away from the interior wall to the reject region; and a controller communicatively coupled to the sensor, the controller moving the diverter from the first position to the second position in response to the sensor detecting an invalid coin.

172. The coin processing system of claim 171 further including a gauging channel for aligning outer edges of the coins along a gauging wall immediately prior to the at least two exit channels.

173. The coin processing system of claim 172 further including a transition area between the gauging channel and the queuing channel to allow coins to move from an interior wall within the queuing channel to the gauging wall within the gauging channel.

174. The coin processing system of claim 173 wherein the coins are under pressure between the rotatable disc and the sorting head when moving through the transition area.

175. The coin processing system of claim 173 wherein the coins are under no pressure when moving through the transition area.

176. The coin processing system of claim 171 wherein the reject region includes a reject slot into which coins are diverted by the diverter.

177. The coin processing system of claim 176 wherein the reject slot leads coins to a periphery of the sorting head.

178. The coin processing system of claim 177 wherein the reject slot has a length of no more than about three times the diameter of the smallest authentic coin to be processed.

179. The coin processing system of claim 171 wherein the rotatable disc includes a pad, the coins being under pad pressure when moving through the queuing channel.

180. The coin processing system of claim 171 wherein the queuing channel includes an inner wall against which the coins abut and has, in a cross-sectional view, a stepped profile that defines a first edge and a second edge, the first edge being closer to the inner wall than the second edge.

181. The coin processing system of claim 180 wherein inner edges of the coins engage the inner wall, coins of a smaller diameter engaging the first edge, coins of a larger diameter engaging the second edge.

182. The coin processing system of claim 181 wherein the coins remain under pressure between the rotatable disc and the sorting head while moving along the first edge and the second edge.

183. The coin processing system of claim 171 wherein the queuing channel terminates at a location adjacent to a periphery of the rotatable disc.

184. The coin processing system of claim 171 wherein the sensor determines the denomination of each valid coin, the controller determining the value of the coins being processed based on input from the sensor.

185. The coin processing system of claim 171 wherein the at least two exit channels includes an exit channel for each available denomination to be sorted.

186. The coin processing system of claim 185, further including a counting sensor in each of the exit channels, the counting sensors being coupled to the controller, the controller determining the value of the coins being processed based on inputs received from the counting sensors.

187. The coin processing system of claim 171 further including a trigger sensor positioned immediately upstream from the sensor, the sensor being activated to determine characteristics of a particular coin in response to the expiration of a certain time period occurring after the trigger sensor detects the particular coin.

188. The coin processing system of claim 171 wherein the diverter includes a voice coil for high speed activation.

189. The coin processing system of claim 171 wherein the coins are aligned along an inner wall of the second segment of the queuing channel, the diverter being immediately adjacent to the inner wall for causing coins to be diverted away from the inner wall and toward the reject region.

190. The coin processing system of claim 189 wherein the second segment of the queuing channel includes a coin engaging surface immediately adjacent to the inner wall, the reject region including a reject slot that is immediately adjacent to the coin engaging surface.

191. The coin processing system of claim 190 wherein the coin engaging surface has a width measured in a radial direction that is approximately the width of the diverter when the diverter is in the second position.

192. The coin processing system of claim 191 wherein the diverter is a divertin that protrudes downwardly from the coin engaging surface.

193. The coin processing system of claim 171 wherein the discriminator determines a metal content and a dimension of the coins.

194. The coin processing system of claim 171 wherein the diverter is actuated by a solenoid.

195. The coin processing system of claim 171 wherein the queuing channel is generally L-shaped.

196. The coin processing system of claim 171 wherein the first segment is disposed at an angle of about 90 degrees to about 110 degrees relative to the second segment.

197. The coin processing system of claim 196 wherein the angle is about 100 degrees.

* * * * *

UNITED STATES PATENT AND TRADEMARK OFFICE

CERTIFICATE OF CORRECTION

PATENT NO. : 6,755,730 B2
DATED : June 29, 2004
INVENTOR(S) : Geib et al.

It is certified that error appears in the above-identified patent and that said Letters Patent is hereby corrected as shown below:

Column 18,
Line 66, remove second instance of “a”

Column 19,
Line 4, remove the word “channel” and insert -- channels --
Line 15, insert the word -- region -- after the word “reject”
Line 20, remove second instance of “a” and insert -- are --
Line 25, remove the word “coin” and add -- coins --

Column 20,
Line 8, remove “activation” and insert -- activating --
Line 15, remove “denomiantion” and insert -- denomination --
Line 20, remove “occure” and insert -- occurs --

Column 21,
Line 3, remove “dischargeing” and insert -- discharging --
Line 12, remove “invlaid” and insert -- invalid --
Line 15, remove “outisde” and insert -- outside --
Line 58, remove “quening” and insert -- queuing --

Column 22,
Line 64, remove “include” andinsert -- includes a --

Column 34,
Line 6, remove “divertin” and insert -- diverting pin --

Signed and Sealed this

Twenty-second Day of February, 2005

JON W. DUDAS
*Director of the United States Patent and Trademark Office*